US011315536B2

(12) United States Patent
Misawa

(10) Patent No.: US 11,315,536 B2
(45) Date of Patent: Apr. 26, 2022

(54) SOUND REGULATION APPARATUS, METHOD OR PROGRAM

(71) Applicant: Miyoko Misawa, Kawasaki (JP)

(72) Inventor: Daichi Misawa, Kawasaki (JP)

( * ) Notice: Subject to any disclaimer, the term of this patent is extended or adjusted under 35 U.S.C. 154(b) by 212 days.

(21) Appl. No.: 16/517,631

(22) Filed: Jul. 21, 2019

(65) Prior Publication Data

US 2020/0043455 A1 Feb. 6, 2020

(30) Foreign Application Priority Data

Jul. 31, 2018 (JP) ..... JP2018-143198

(51) Int. Cl.
*G10H 5/10* (2006.01)
*G10H 1/08* (2006.01)
(Continued)

(52) U.S. Cl.
CPC ..... *G10H 5/10* (2013.01); *G10H 1/0008* (2013.01); *G10H 5/002* (2013.01); *G10H 2220/461* (2013.01); *G10H 2250/055* (2013.01)

(58) Field of Classification Search
CPC .. G10H 3/24; G10H 3/26; G10H 5/02; G10H 5/06; G10H 5/10; G10H 2210/281; Y10S 84/26; Y10S 84/10
See application file for complete search history.

(56) References Cited

U.S. PATENT DOCUMENTS 6,157,724 A * 12/2000 Kawakami ..... G10K 15/08 381/61
8,378,200 B1 * 2/2013 Beigel ..... G10H 1/0025 84/659
(Continued)

FOREIGN PATENT DOCUMENTS

JP 61296896 A * 12/1986
JP H5-088674 4/1993
JP H9-63866 A 9/1998
/10-247089

OTHER PUBLICATIONS

Misawa, Daichi, Culturalities, Transactions of the Virtual Reality Society of Japan, Japan, 2016年, vol. 21, No. 3, pp. 423-436.
(Continued)

*Primary Examiner* — Daniel J Colilla
(74) *Attorney, Agent, or Firm* — Chen-Chi Lin

(57) ABSTRACT

[Technical problem] Circulatory sound regulation that changes environmental sound into input sound, converted sound with arbitrarily regulatory frequency component, arbitrarily regulatory amplitude or both of them, output sound, another input sound synthesized with this output sound and an environmental sound, and another converted sound made from this input sound. [Solution] Apparatus comprising: input means that receives environmental sound from arbitrary environment as an input sound; conversion means that converts the input sound into a converted sound that contains arbitrarily regulatory frequency component including frequency component that approximates to principle oscillator, arbitrarily regulatory amplitude or both; and output means that transmits the converted sound to environment as an output sound; whereby the input means receives synthetic sound synthesized with the output sound and environmental sound as an input sound again, and the conversion means converts this input sound further into another converted sound.

9 Claims, 16 Drawing Sheets

(51) Int. Cl.

| | |
|---|---|
| ***G10H 1/12*** | (2006.01) |
| ***G10H 1/46*** | (2006.01) |
| ***G10H 5/00*** | (2006.01) |
| ***G10H 1/00*** | (2006.01) |

(56) References Cited

U.S. PATENT DOCUMENTS

2003/0121403 A1* 7/2003 Miyagishima ..... G10H 1/0091 84/735
2003/0126975 A1* 7/2003 Urai ..... G10H 1/0091 84/737

OTHER PUBLICATIONS

Dobson, Richard, Audio Programming in C, in The Audio Programming Book, The MIT Press, Cambridge, Massachusetts, England.
Misawa, Daichi, "Data Auditorio: Towards intense interaction, an interactive hyper-directional sound for play and ubiquity," in Proceedings of ICMC2014, Athens, ICMA, 2014.
Misawa, Daichi, "Transparent Sculpture: An embodied auditory interface for sound sculpture," in Proceedings of TEI '13. New York, NY, USA: ACM 2013.
Misawa, Daichi, "Reverence in Ravine: A transparent sculpture in coordinate space for installation art," in Proceedings of VSMM, Milan, IEEE 2012.

* cited by examiner

SOUND REGULATION APPARATUS, METHOD OR PROGRAM

FOREIGN PRIORITY

The invention requests the examiner to retrieve an electronic patent application filed in Japan Patent Office on Jul. 31, 2018. Application number, patent registration number and access code are 2018-143198, 6503121 and 36C8 respectively. For further information, see attached document of PTO/SB/38 (12-18).

ENTITY STATUS

The inventor is a sole inventor and micro entity. For further information, see attached document of PTO/SB/15A (07-14).

TECHNICAL FIELD

The invention relates, generally, to an apparatus, method or program for sound regulation that changes an environmental sound into an input sound, changes said input sound into a converted sound with arbitrarily regulatory frequency component, arbitrarily regulatory amplitude or both, changes said converted sound into an output sound, changes said output sound along with environmental sound into an input sound again and changes this input sound further into a converted sound; that is, this relates to the regulation of a circulatory sound (hereafter circulator).

PRIOR ART

Two examples of prior art are described in this section, which carry out synthesis, regulation or both of environmental sound. These examples, generally, relate to computer music, virtual reality of music, interface design of music, interaction design of music, part of those or all.

Transparent Sculpture (hereafter Sculpture), briefly, is an environmental sound regulation apparatus that appears to be like a performing arts stage. It is an arbitrary environment furnished with one or more super-directional loudspeakers. Like a performing artist, visitor to said environment could be an attribute of said environment. In sound regulation, Sculpture carries out a series of steps comprising: sampling environmental sound in real-time, regulating dynamics using compressor and so on, transmitting to said environment and iterating those regulatory processes of environmental sound constantly. As a result, Sculpture constructs a three-dimensional structure provided with one or more focal points of super-directional sound using said environment as the sound source.

Data Auditorio (hereafter Auditorio), briefly, is an environmental sound regulation apparatus that appears to be like a karaoke performance stage. It is an arbitrary environment furnished with one or more super-directional loudspeakers. Like a singer, visitor to said environment could be an attribute of said environment. In sound regulation, Auditorio carries out a series of steps comprising: sampling environmental sound in real-time, regulating dynamics using compressor and so on, adding granular synthesis, transmitting to said environment and iterating those regulatory processes of environmental sound constantly. (Granular synthesis is a sound synthesis technique that divides an arbitrary sound sample into sound grains (i.e. sound snippets of 10 millisecond or less than 10 millisecond), and plays said sound grains while rearranging the original play-order (sequence) of said sound grains e.g. randomly.) As a result, Auditorio constructs a three-dimensional structure provided with one or more focal points of super-directional granular sound, using said environment as the sound source.

However, problem of two said examples of prior art is that, although they are able to add sound effects or granular synthesis to an environmental sound giving rise to a different sound as a result that may have randomly resonating complex timbre, they have not accomplished a thing that might sound contradictory but one would not be able to deny its potential realization through interface design, interaction design and so forth; that is an attempt that: (1) while letting sound interactions emerge continuously between an arbitrary environment and the invention, (2) receiving a manifest environmental sound (which often is called noise) from said environment clearly and (3) maintaining an arbitrary frequency component like principle component of oscillator constantly.

In other words, those said examples of prior art are able to change a said noise into another noisy sound including drone using sound effect, granular synthesis, etc. (Drone is a type of sound approximating to continuous sound like hum.) Yet, they are still not able to simultaneously and constantly regulate a sound clearly containing both of a component of said noise and a component approximating to principle oscillator. (See FIG. 25 for the plot visualizing a sound data that solved this problem).

In such circumstances today, for instance, even if one were to use an arbitrary environment as the sound source, one would not be able to carry out musical composition, musical regulation or both of them based on a set of tuned sounds that constitutes a musical scale. If one were to apply two said examples as a basic technology for musical expression, one would face considerable difficulties eventually in playing a musical instrument like piano or flute that controls or tunes environmental sound, making as a result discords or incorrectly tuned sounds (see FIG. 8 for a drawing illustrating musical instruments controlling circulator sound). Currently, using existing technologies and taking advantage of environmental sound as the source, one is only able to regulate kinds of noise; in a nutshell, today, it is not necessarily difficult to make a noise into another one.

Therefore, an invention thought to be requested today would be: (although it might be important to construct any musical scale by tuning a set of environmental sounds, to be more specific) a sound regulation technology that carries out conversion, regulation or both of environmental sound, changing said environmental sound into another sound with arbitrarily regulatory frequency component, arbitrarily regulatory amplitude or both. With this invention, one will be able to regulate a sound with components approximating to noise and so on, in addition to a sound with components approximating to principle oscillators.

SUMMARY OF INVENTION

Technical Problem

Technical problem relates generally to an apparatus, method or program for sound regulation that changes an environmental sound into an input sound, changes said input sound into a converted sound with arbitrarily regulatory frequency component, arbitrarily regulatory amplitude or both, changes said converted sound into an output sound, changes said output sound along with environmental sound into an input sound again and changes this input sound further into a converted sound; the technical problem relates to circulator regulation.

Solution to Problem

Solutions

Following this paragraph, sound regulation apparatus, method or program, which is the invention, is described as a set of solutions to said technical problem above. The solutions of method and program are based on the solutions of apparatus.

1.

Sound regulation apparatus that is able to change an environmental sound into an input sound, change an input sound into a converted sound with arbitrarily regulatory frequency component, arbitrarily regulatory amplitude or both, change a converted sound into an output sound transmitted to environment, change an output sound together with environmental sound into an input sound again, and change this input sound further into a converted sound, comprising:

input means that receives an environmental sound derived from arbitrary environment as an input sound;

conversion means that converts said input sound into a converted sound that contains arbitrarily regulatory frequency component including frequency component that approximates to sine-wave oscillator, sawtooth-wave oscillator, square-wave oscillator or triangle-wave oscillator, arbitrarily regulatory amplitude or both; and output means that transmits said converted sound as an output sound to said environment;

whereby said input means receives a synthetic sound synthesized with said output sound and environmental sound as an input sound again, and said conversion means converts this input sound further into a converted sound.

2.

The apparatus as set forth in Solution 1, wherein said conversion means further comprises:

amplifier 1 that increases or decreases the amplitude of said input sound;

filter 1 that resonates an arbitrary frequency component of a sound derived from said amplifier 1;

dynamics processor 1 that regulates amplitude level and adjusts dynamic range of a sound derived from said filter 1; and amplifier 2 that adjusts the master output level of said converted sound.

3.

The apparatus as set forth in Solution 1, wherein said conversion means further comprises:

circulator bank that reproduces said input sound and changes those reproduced sounds into an input sound array that has arbitrary number of elements;

amplifier 1 that increases or decreases the amplitude of each element in said circulator bank;

filter 1 that resonates an arbitrary frequency component of each element in said circulator bank after said processing with amplifier 1;

dynamics processor 1 that regulates amplitude level and adjusts dynamic range of each element in said circulator bank after said processing with filter 1;

amplifier 3 that increases or decreases the amplitude of each element in said circulator bank after said processing with dynamics processor 1;

amplifier 4 that scales the amplitudes of all elements in said circulator bank after said processing with amplifier 3;

additive synthesizer 1 that additively synthesizes all elements in said circulator bank after said processing with amplifier 4; and amplifier 2 that adjusts the master output level of said converted sound.

4.

Sound regulation method that is able to change an environmental sound into an input sound, change an input sound into a converted sound with arbitrarily regulatory frequency component, arbitrarily regulatory amplitude or both, change a converted sound into an output sound transmitted to environment, change an output sound together with environmental sound into an input sound again, and change this input sound further into a converted sound, comprising a series of steps of:

receiving an environmental sound derived from arbitrary environment as an input sound;

converting said input sound into a converted sound with arbitrarily regulatory frequency component including frequency component that approximates to sine-wave oscillator, sawtooth-wave oscillator, square-wave oscillator or triangle-wave oscillator, arbitrarily regulatory amplitude or both; and transmitting said converted sound as an output sound to said environment;

whereby receiving a synthetic sound synthesized with said output sound and environmental sound as an input sound again, and converting this input sound further into a converted sound.

5.

The method as set forth in Solution 4, wherein said converting step further comprises a series of steps of:

increasing or decreasing the amplitude of said input sound;

resonating an arbitrary frequency component;

regulating amplitude level and adjusting dynamic range; and adjusting the master output level.

6.

The method as set forth in Solution 4, wherein said converting step further comprises a series of steps of:

reproducing said input sound and changing those reproduced sounds into a circulator bank that has arbitrary number of elements;

increasing or decreasing the amplitude of each element in said circulator bank;

resonating an arbitrary frequency component of said each element;

regulating amplitude level and adjusting dynamic range of said each element;

increasing or decreasing the amplitude of said each element;

scaling the amplitudes of all elements in said circulator bank;

additively synthesizing all elements in said circulator bank; and adjusting the master output level of said converted sound.

7.

Sound regulation program that is in sound regulation apparatuses able to change an environmental sound into an input sound, change an input sound into a converted sound with arbitrarily regulatory frequency component, arbitrarily regulatory amplitude or both, change a converted sound into an output sound transmitted to environment, change an output sound together with environmental sound into an input sound again, and change this input sound further into a converted sound, comprising a set of instructions for functioning as:

input means that receives an environmental sound derived from arbitrary environment through AD conversion as an input sound;

memory means that writes said input sound to a memory;

conversion means that reads said input sound from said memory, and converts said input sound into a converted sound that contains arbitrarily regulatory frequency component including frequency component that approximates to sine-wave oscillator, sawtooth-wave oscillator, square-wave oscillator or triangle-wave oscillator, arbitrarily regulatory amplitude or both;

memory means that writes said converted sound to a memory; and output means that reads said converted sound from said memory, and transmits said converted sound as an output sound to said environment through DA conversion;

whereby said input means receives a synthetic sound synthesized with said output sound and environmental sound as an input sound again, and said conversion means converts this input sound further into a converted sound.

8.

The program as set forth in Solution 7, wherein said conversion means further comprises a set of instructions for functioning as:

amplifier 1 that, after said input sound is read from said memory, increases or decreases the amplitude of said input sound;

filter 1 that resonates an arbitrary frequency component of a sound derived from said amplifier 1;

dynamics processor 1 that regulates amplitude level and adjusts dynamic range of a sound derived from said filter 1; and amplifier 2 that adjusts the master output level of said converted sound.

9.

The apparatus as set forth in Solution 7, wherein said conversion means further comprises a set of instructions for functioning as:

circulator bank that, after said input sound is read from said memory, reproduces said input sound and changes those reproduced sounds into an input sound array that has arbitrary number of elements;

amplifier 1 that increases or decreases the amplitude of each element in said circulator bank;

filter 1 that resonates an arbitrary frequency component of each element in said circulator bank after said processing with amplifier 1;

dynamics processor 1 that regulates amplitude level and adjusts dynamic range of each element in said circulator bank after said processing with filter 1;

amplifier 3 that increases or decreases the amplitude of each element in said circulator bank after said processing with dynamics processor 1;

amplifier 4 that scales the amplitudes of all elements in said circulator bank after said processing with amplifier 3;

additive synthesizer 1 that additively synthesizes all elements in said circulator bank after said processing with amplifier 4; and amplifier 2 that adjusts the master output level of said converted sound.

Advantageous Effects of Invention

The invention, generally, enables a sound regulation that changes an environmental sound into an input sound, changes said input sound into a converted sound with arbitrarily regulatory frequency component, arbitrarily regulatory amplitude or both, changes said converted sound into an output sound, changes said output sound along with environmental sound into an input sound again and changes this input sound further into a converted sound; advantageous effect of the invention is for one to enable circulator regulation.

EMBODIMENTS

<<Introduction>>

<Descriptive Structure>

On embodiments of the invention are described in the following sections below. Embodiments 1-5 are the primary embodiment of the invention. For explanation of terms or additional explanation of Figures, see later sections of Explanation of Terms or Additional Explanation of Figures respectively.

<On Values>

Without particular note, values of amplitude and so on, generally, are expressed with values from 0.0 to 1.0. Sampling rate and bit-depth of sound card, in other words audio interface used as input means and output means in the following embodiments, work in 44.1 kHz and in 24 bit-depth respectively.

List of Embodiments

Embodiment list (including elements written in round brackets) of apparatus, method and program is listed below.

(Apparatus List)

Embodiment 1 (circulator regulation apparatus, arbitrarily regulatory frequency component, arbitrarily regulatory amplitude).

Embodiment 2 (subtractive synthesis, sine-wave circulator regulation apparatus, arbitrarily regulatory frequency component).

Embodiment 3 (subtractive synthesis, sine-wave circulator regulation apparatus, arbitrarily regulatory frequency component, arbitrarily regulatory amplitude).

Embodiment 4 (additive synthesis, circulator regulation apparatus, arbitrarily regulatory frequency component, arbitrarily regulatory amplitude).

Embodiment 5 (additive synthesis, sawtooth-wave circulator regulation apparatus, arbitrarily regulatory frequency component, arbitrarily regulatory amplitude).

(Method List)

Embodiment 6 (circulator regulation method, arbitrarily regulatory frequency component, arbitrarily regulatory amplitude).

Embodiment 7 (subtractive synthesis, sine-wave circulator regulation method, arbitrarily regulatory frequency component, arbitrarily regulatory amplitude).

Embodiment 8 (additive synthesis, circulator regulation method, arbitrarily regulatory frequency component, arbitrarily regulatory amplitude).

(Program List)

Embodiment 9 (circulator regulation program, arbitrarily regulatory frequency component, arbitrarily regulatory amplitude).

Embodiment 10 (subtractive synthesis, sine-wave circulator regulation program, arbitrarily regulatory frequency component, arbitrarily regulatory amplitude).

Embodiment 11 (additive synthesis, circulator regulation program, arbitrarily regulatory frequency component, arbitrarily regulatory amplitude).

<Figures to Overview>

Figure 1:
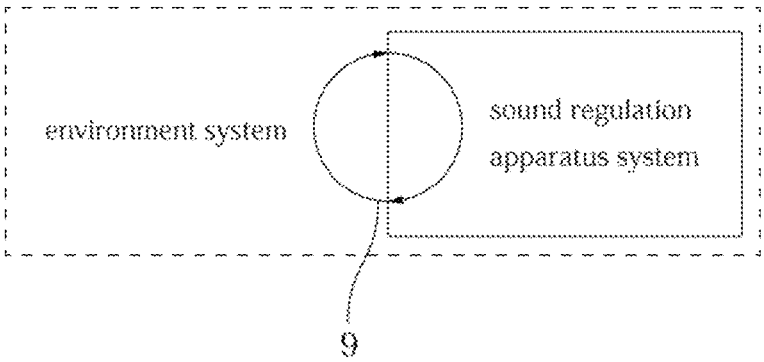
FIG. 1 Ideal model of interaction between environment and invention.
Figure 11:
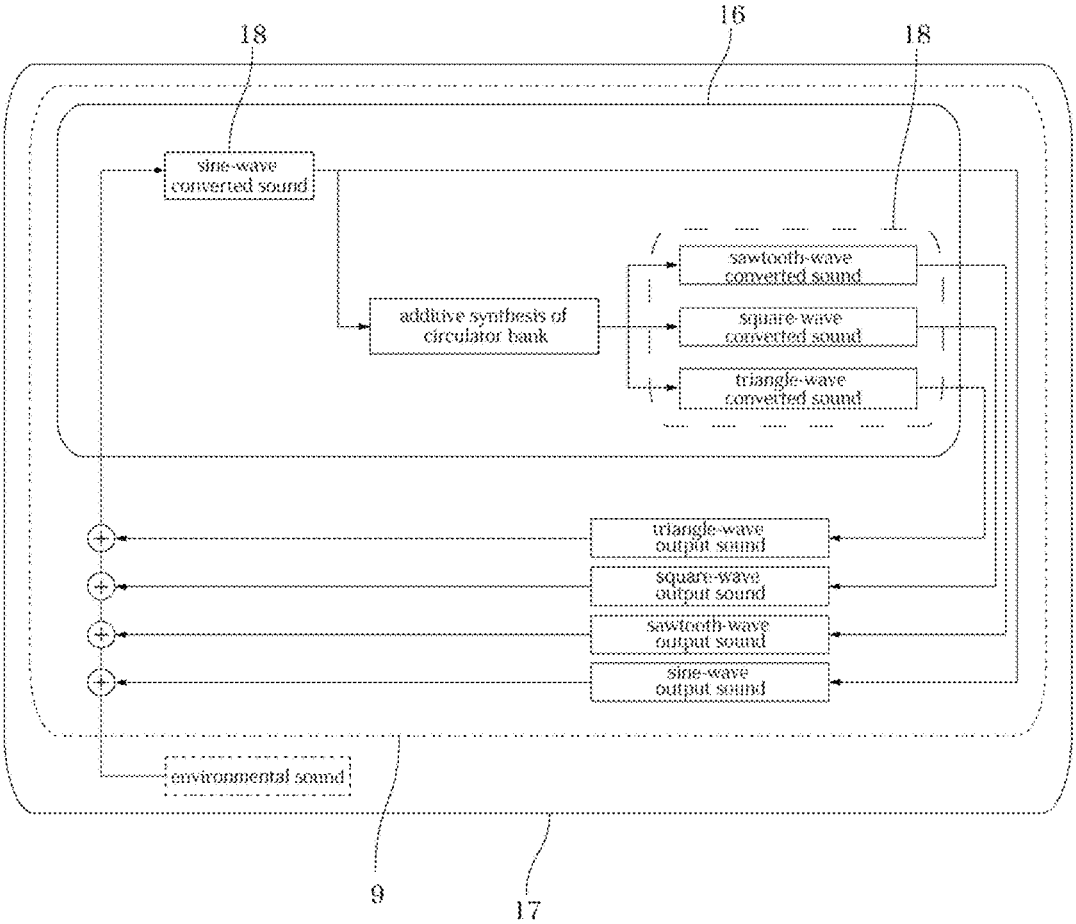
FIG. 11 Overview of principle circulator regulation processes; abstract of processing regulating principle circulators.

For figure of environment-invention interaction that is the principle of the invention, see FIG. 1. Circulator, in ideal, is an interface between an environment and the invention enabling interaction (see FIG. 2). For drawing of embodiments of the invention, see FIGS. 7-10. For overviewing the continuous circulatory regulation process of the principle circulators (sine-wave circulator, sawtooth, square and triangle), see FIG. 11. For circulator plots such as spectrogram, see FIGS. 18-26D (for a plot that intensities of both regulatory sound and manifest environmental sound are simultaneously emerging, see FIG. 25).

Embodiment 1

<Circulator Regulation Apparatus, Arbitrarily Regulatory Frequency Component, Arbitrarily Regulatory Amplitude>

Figure 12:
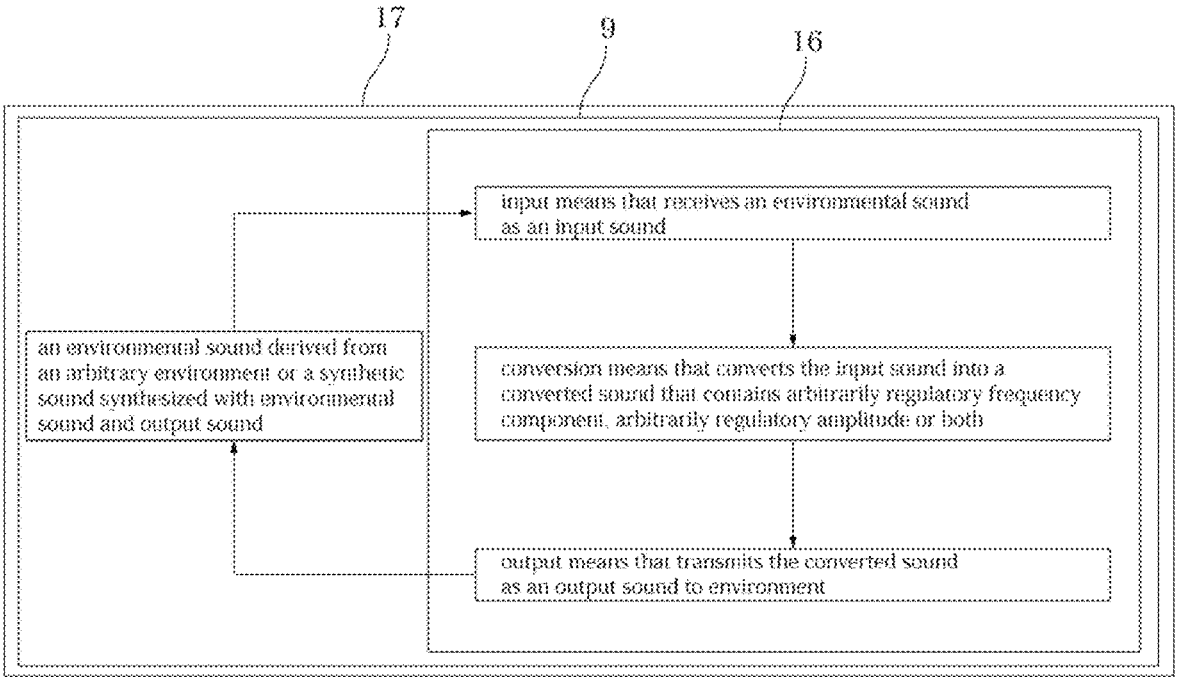
FIG. 12 shows a system block diagram of the sound regulation apparatus in examples of the present disclosure.
Figure 13:
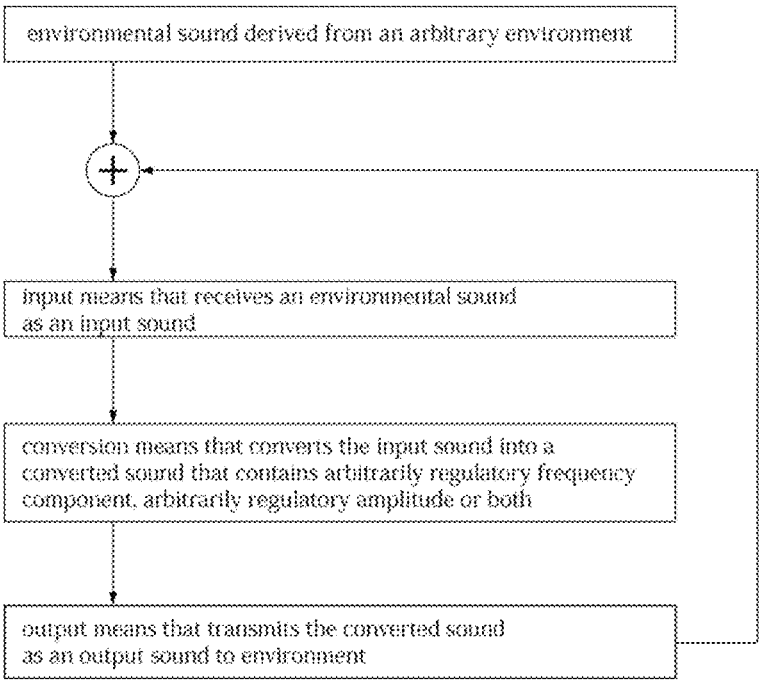
FIG. 13 shows a flow chart of the sound regulation apparatus in examples of the present disclosure.

Embodiment 1 is described below. This is an apparatus that regulates circulator with arbitrarily regulatory frequency component, arbitrarily regulatory amplitude or both of them. This may also regulate circulator with unnatural regulatory frequency component, circulator approximating to noise and so on, in addition to circulator approximating to sine-wave oscillator, sawtooth-wave, square-wave or triangle-wave. For the system block diagram and flowchart, see FIGS. 12-13.

<Abstract>

Embodiment 1 is a sound regulation apparatus, which changes an environmental sound into an input sound, changes said input sound into a converted sound with arbitrarily regulatory frequency component, arbitrarily regulatory amplitude or both, changes said converted sound into an output sound, changes said output sound along with environmental sound into an input sound again, and changes this input sound further into a converted sound; this is a general circulator regulator that gives rise to an arbitrary sound of circulator in an arbitrary environment.

<Environment>

Environment is the sound source of Embodiment 1, which is naturally oscillating because of e.g. person behavior and so on (in this Specification, natural oscillation includes behavior of person, artifact, etc. for effective description of the invention). Sound caused by natural oscillation is recognized as an environmental sound when it is heard by people and is done as an input sound when Embodiment 1 receives it with an input means of Embodiment 1 such as omni-directional condenser microphone or arbitrary sound input device.

<Input Means>

Said environmental sound is processed with an input means, transforming into an input sound. Said input means may be something like a sound card that carries out AD (analog-to-digital) conversion converting an environmental sound into an input sound. Microphone and the like may be connected to said sound card, where number of them used, their kind and so on are arbitrary.

<Conversion Means>

Said input sound is converted into a converted sound with a conversion means, such as arbitrary computer (for definition of computer, see the section of Explanation of Terms). A converted sound has a frequency component based on arbitrarily regulatory frequency component, an amplitude based on arbitrarily regulatory amplitude or both of them. Although a converted sound may be a sound with component approximating to principle oscillators (sine-wave oscillator, sawtooth-wave oscillator, square-wave oscillator and triangle-wave oscillator), it may also have unnatural component, noisy component and so on.

<Output Means>

Said converted sound then is processed with output means and is transformed into an output sound. Said output means may be a sound card that carries out DA (analog-to-digital) conversion, converting said converted sound into an output sound. Loudspeaker and the like may be connected to the said sound card, where number of them to be used, their kind or type and so on are arbitrary. Said output sound is subsequently transmitted from e.g. said loudspeaker to said environment.

<Return>

Said output sound transmitted to said environment is to be transformed into a synthetic sound, being naturally synthesized, or mixed, with (more or less the present) environmental sound in said environment (in practice, whether said synthesis process is additive or subtractive depends upon artificial behavior, other natural oscillations and so on in environment). Said synthetic sound is to be again, normally, instantly received with said input means as an input sound.

<Circulation>

Between environment and itself, Embodiment 1 continues to interactively carry out a series of continuous circulatory regulatory processes of sound written above (see FIG. 1, for ideal model of environment-invention interaction as the principle of the invention). As a result, this sound regulated with Embodiment 1, which is derived originally from said environment and has arbitrarily regulatory frequency component, arbitrarily regulatory amplitude or both, is to continue to interactively circulate during an arbitrary period between said environment and Embodiment 1. Whether the period is short like a drum sound or long like a hum sound depends on user.

<Emergence>

As said sound, which is derived from environment and is regulated by Embodiment 1, constantly circulates between said environment and Embodiment 1, a continuous sound like a sound ring gradually manifest itself between said environment and Embodiment 1. This ring-like continuous circulatory sound regulated by the invention, or in practice embodiments, is called circulator in the Specification. Circulator is, in other words, a sound that is emerging through regulation by the invention in an environment and contains arbitrarily regulatory frequency component, arbitrarily regulatory amplitude or both. A circulator may be a sound approximating to noise and so on, in addition to a sound tuned for constituting any arbitrary musical scale.

<Significance>

Figure 2:
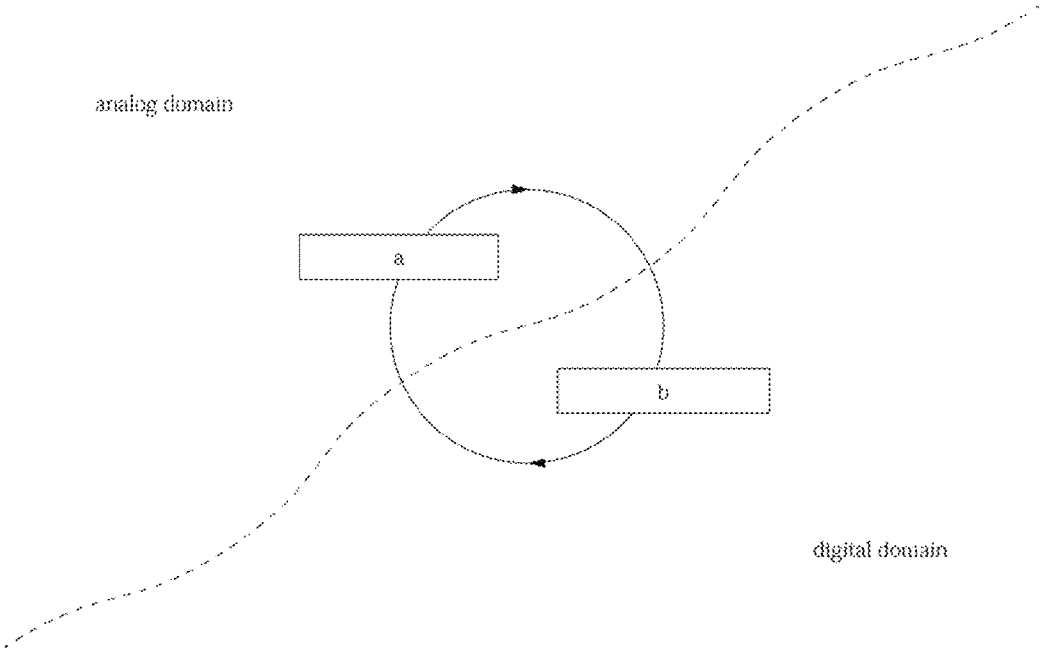
FIG. 2 Ideal model of interface between environment and invention.
Figure 3:
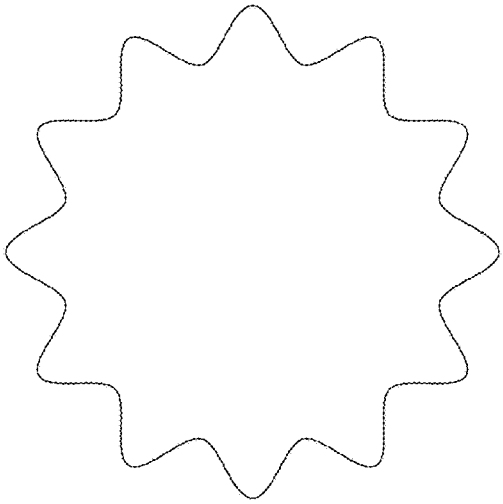
FIG. 3 Ideal model of waveform of sine-wave circulator.
Figure 4:
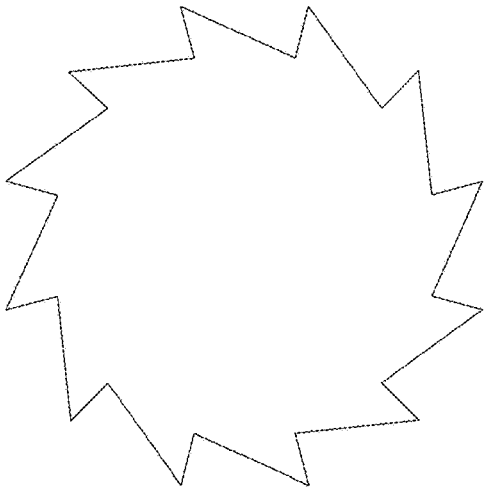
FIG. 4 Ideal model of waveform of sawtooth-wave circulator.
Figure 5:
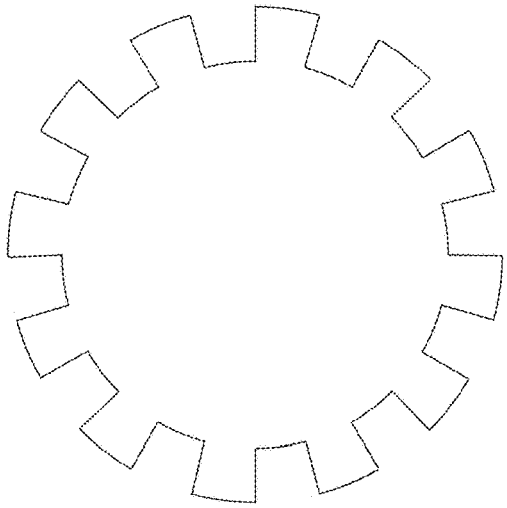
FIG. 5 Ideal model of waveform of square-wave circulator.
Figure 6:
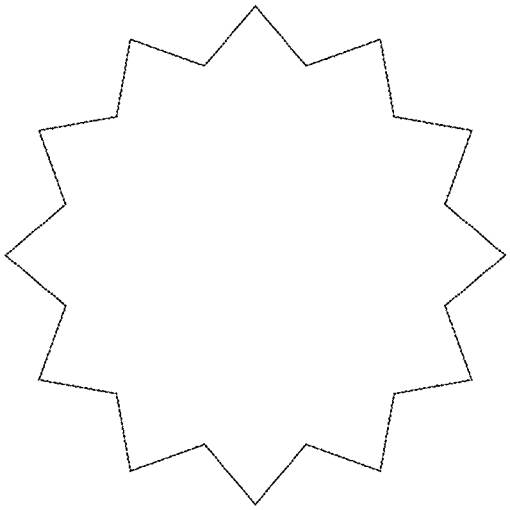
FIG. 6 Ideal model of waveform of triangle-wave circulator.
Figure 7:
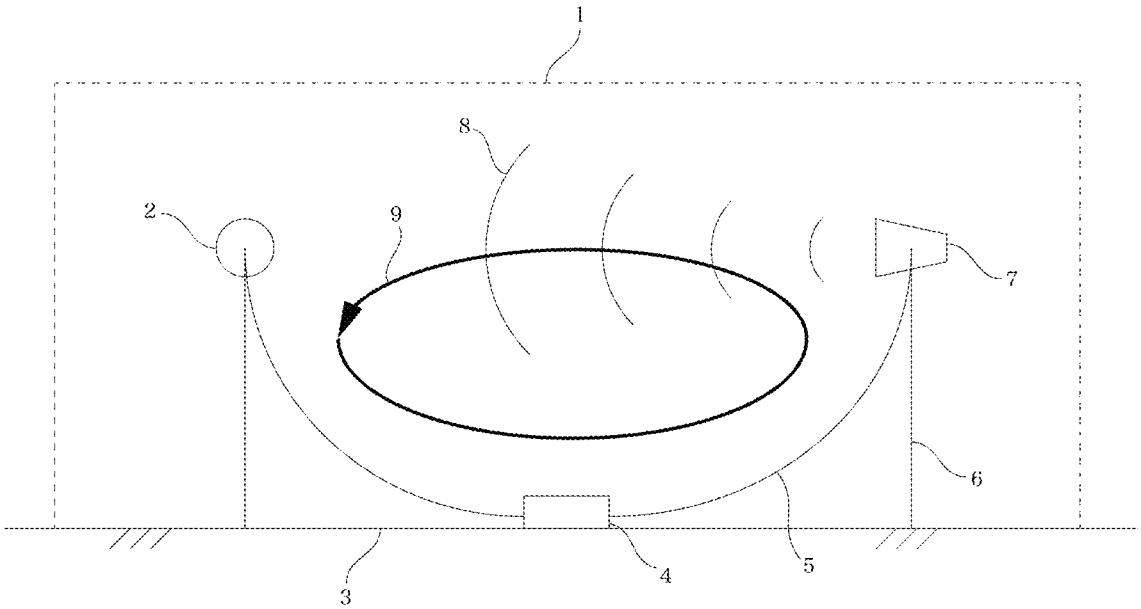
FIG. 7 Figure of an embodiment like sound art installation, background music player, etc.
Figure 8:
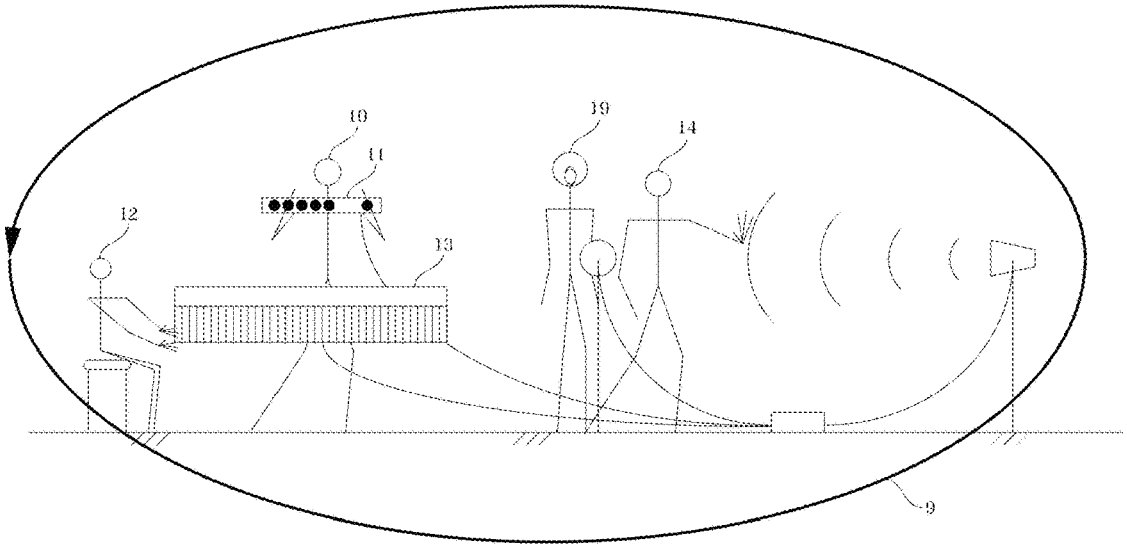
FIG. 8 Figure of an embodiment like acoustic equipment for musical performance stage, performing arts, etc.
Figure 9:
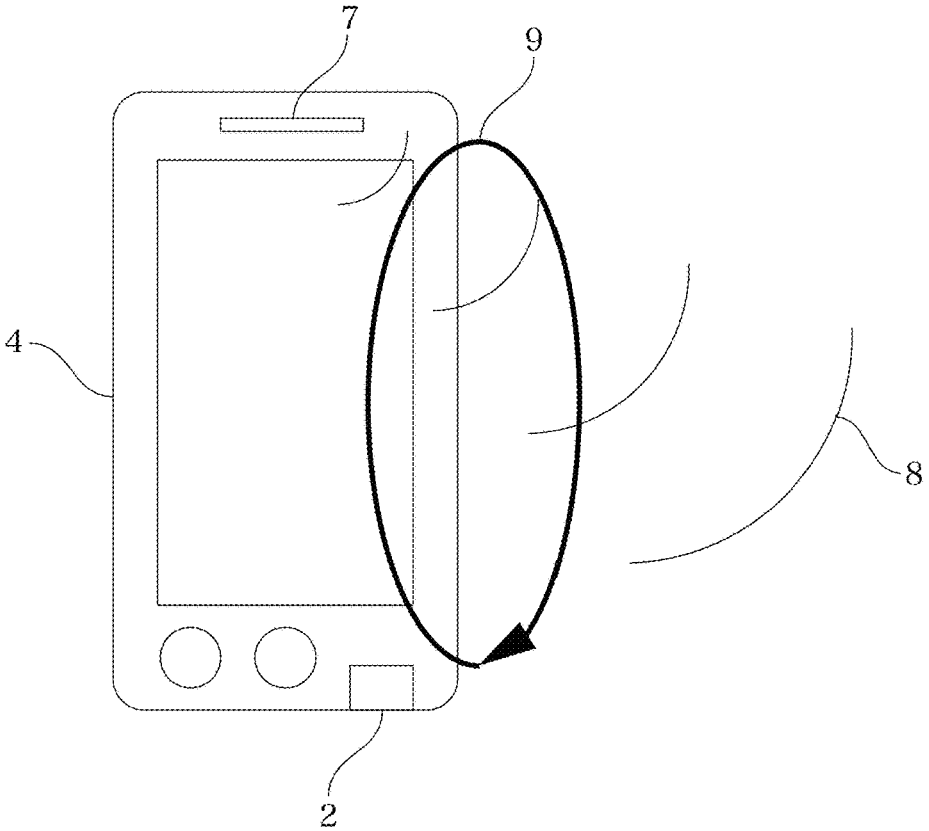
FIG. 9 Figure of an embodiment like handheld audio device, small device, portable device, etc.
Figure 10:
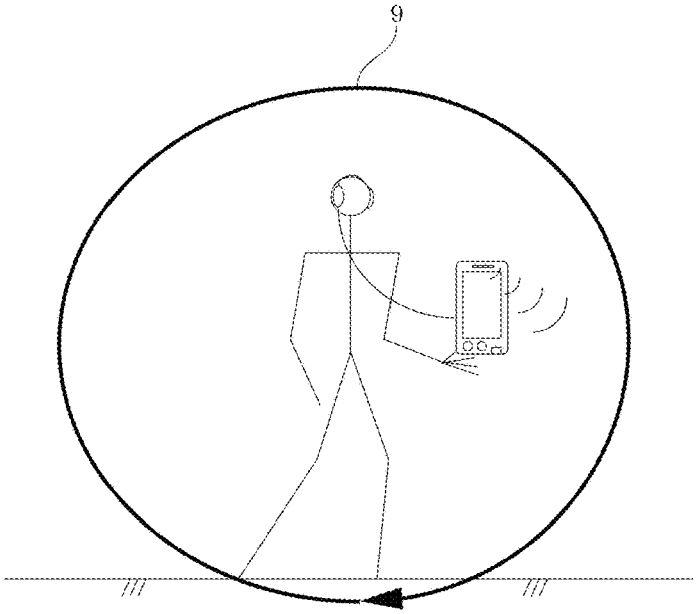
FIG. 10 Figure of a fieldwork regulating circulator and listening to it, using the embodiment of FIG. 9.

Significance of Embodiment 1 is that, based on designing interaction or interface, that is, taking account of the transformation of beings and their behavior belong to an environment (hereafter environmental transformation) as a factor for circulator synthesis, one is able to design environments for circulator synthesis or to compose musical circulator environment using the invention's technology (see FIG. 1-2 for ideal interaction model and ideal interface model between environment and the invention). In other words, by using circulator, the continuity between environment and apparatus may become evident.

Further applications of Embodiment 1 may be thought as sine-wave circulator, sawtooth, square-wave, triangle-wave (which have sound component like sine-wave oscillator, sawtooth, square-wave or triangle-wave, respectively) and so on. They might be used like existing oscillators for sound design, musical composition and so forth (see FIG. 3-6, for ideal models of the principle circulators including sine-wave circulator, sawtooth, square-wave and triangle-wave). In addition, it is expected that Embodiment 1 is applied to performing arts (including musical instrument design, musical performance stage and physical expressions like dance), hand-held device design that is used like field-recording device and so forth (see FIG. 7-10, for drawings of those applications).

By applying the Embodiment 1, one is able to regulate circulator with arbitrarily regulatory frequency component, arbitrarily regulatory amplitude or both. In the next embodiment of Embodiment 2, how to regulate a sine-wave circulator with arbitrarily regulatory frequency component (that is, sine-wave circulator without amplitude regulation) is described. Then, in Embodiment 3, how to regulate a sine-wave circulator with arbitrarily regulatory frequency component and arbitrarily regulatory amplitude (sine-wave circulator that regulates both frequency component and amplitude) is described.

Embodiment 2

<Subtractive Synthesis, Sine-Wave Circulator Regulation Apparatus, Arbitrarily Regulatory Frequency Component>

Figure 14:
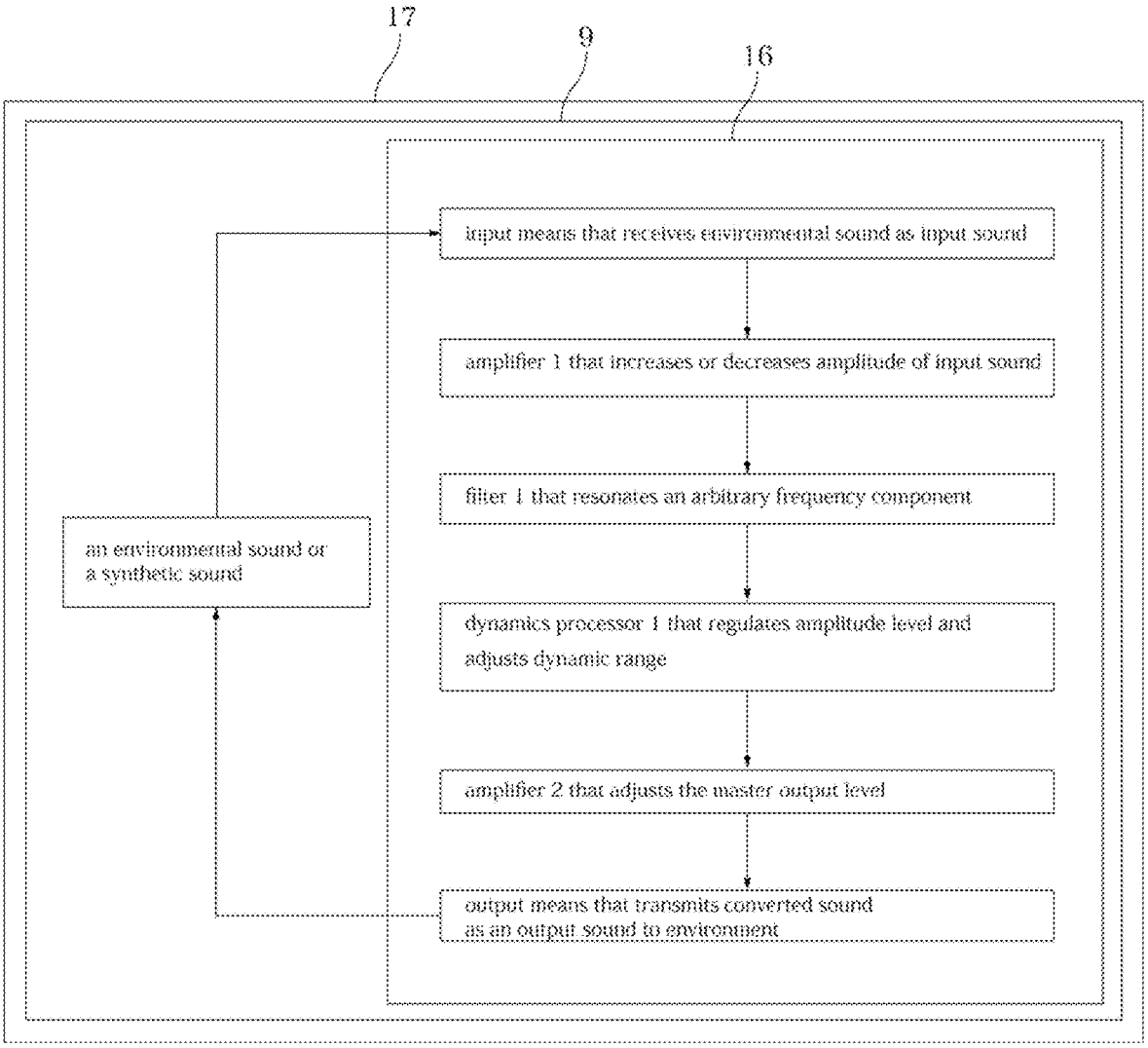
FIG. 14 shows a system block diagram of the sound regulation apparatus in examples of the present disclosure.
Figure 15:
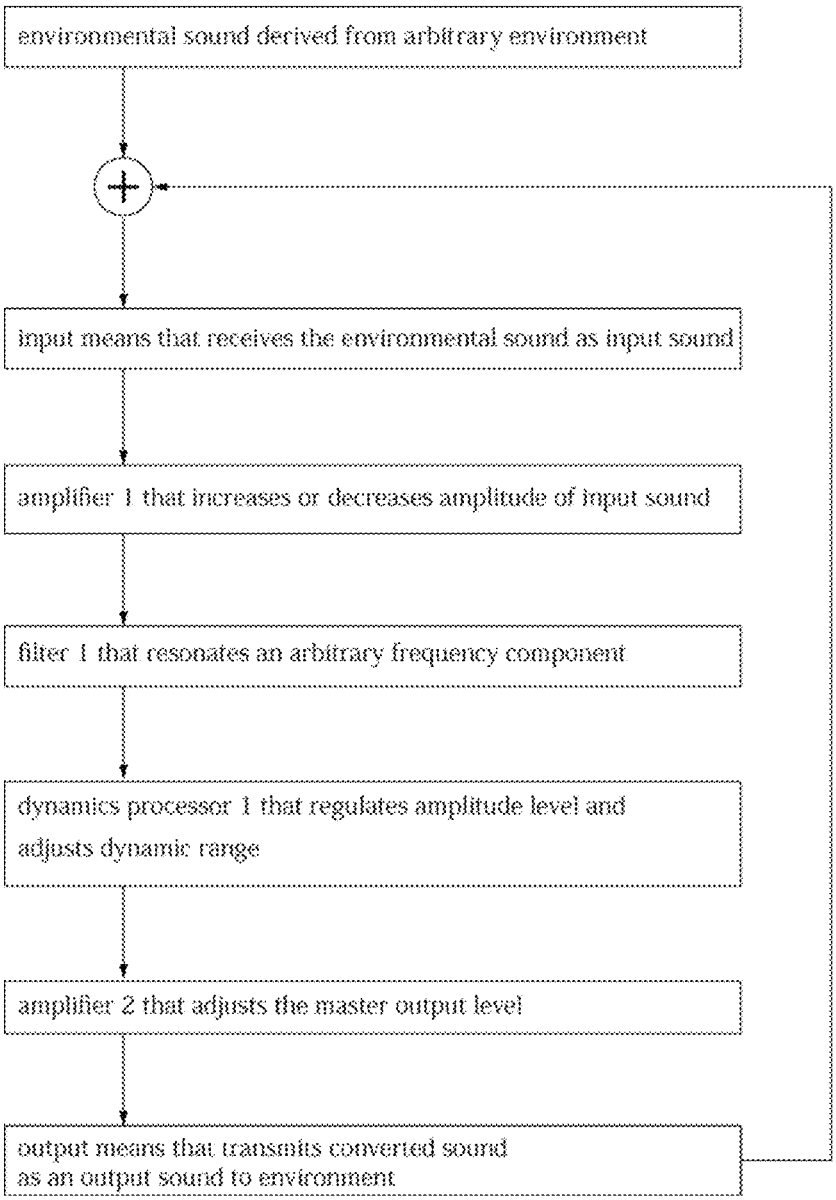
FIG. 15 shows a flow chart of the sound regulation apparatus in examples of the present disclosure.

Embodiment 2 is described in this section, which is subject to Embodiment 1. For the system block diagram and flow chart, see FIG. 14-15.

Embodiment 2 regulates a sine-wave circulator with arbitrarily regulatory frequency component through a process like a subtractive synthesis that is a technique to reduce unrequired sound component(s) with e.g. filter. Said input sound, first, is processed with amplifier 1 unit within said conversion means.

Amplifier 1 may increase or decrease the amplitude of said input sound. Purpose of using amplifier 1 is, but is not limited to, increasing the amplitude of said input sound when environmental sound is low level or quiet (in practice amplification with amplifier 1 would be necessary even if the level of said environmental sound were not necessarily low level, or loud to some extent). Practical degree of amplification with amplifier 1 is arbitrary, which depends on existing environmental conditions. For instance, degrees of amplification may be 20 times as many as the original level of input sound, more than 20 times or less then 20 times. Criteria for how to use amplifier 1 in practice depend on user. Said input sound processed with amplifier 1, then, is processed with another unit of filter 1.

Filter 1 may resonate arbitrary frequency component of a sound derived from said amplifier 1, reducing unnecessary sound component (which is the subtractive processing in Embodiment 2). Concretely, resonance filter may be used as filter 1. Purpose of using filter 1 is, but is not limited to, regulating the fundamental (i.e. fundamental frequency) of a circulator sound. Basic technique to achieve this is to resonate the frequency component at an arbitrary cutoff frequency of circulator, intensifying almost only a certain arbitrary frequency component. For instance, when one would like to have a 220 Hz sine-wave circulator arise in an environment, being taking advantage of a low-pass resonance filter, the pole frequency of said resonance filter may be set to 220 Hz and the pole radius to 0.999. Whether a function for maintaining constant filter gain, such as equal-gain-zeros, is used depends on user. Values of those variables or parameters described above are example values for Embodiment 2. Thus, value of said pole frequency might be 20000 Hz in other embodiment, which may give rise to a circulator with a manifest frequency component of this value. Value of said pole radius, similarly, is subject to adjustment by user, but, if the value were too low, sound intensity (at the pole frequency: arbitrarily regulatory frequency component of a sine-wave circulator) would naturally decrease, having this circulator sound be almost inaudible or like a kind of noise as a result. In the next process, this filtered sound is processed with the unit of dynamics processor 1.

Dynamics processor 1 may adjust dynamic range of a sound derived from said filter 1, regulating degree of amplitude. Purpose of using dynamics processor 1 is, but is not limited to, compression of sound or limitation (that is, it may be used as a compressor effector or limiter), but it may also for example be used as a distortion effector if user wants. In this Embodiment 2, dynamics processor 1 is used as a limiter that would be one of the basic ways for regulating a sine-wave circulator. Example values set to parameters of said dynamics processor 1 may be as follows: 0.5 to threshold, 0.1 to slopeAbove, 1.0 to slopeBelow, 5 millisecond to attack, 300 millisecond to release. With these values, a sine-wave circulator would stably be regulated being under one's control.

With the conversion means provided with these units, one can control a sine-wave circulator with arbitrarily regulatory frequency component. However, based on Embodiment 2, it is not able to adjust the volume of said converted sound or said output sound. Accordingly, it would be considered that another embodiment is requested here. About this will be described in Embodiment 3.

Embodiment 3

<Subtractive Synthesis, Sine-Wave Circulator Regulation Apparatus, Arbitrarily Regulatory Frequency Component, Arbitrarily Regulatory Amplitude>

Embodiment 3 is described below. It is subject to Embodiment 1. Additional function that it has to Embodiment 2 is that it is able to regulate amplitude of a sine-wave circulator. For the system block diagram and flow chart, see FIG. 14-15.

Embodiment 3 is a sound regulation apparatus that, through processing like a subtractive synthesis reducing sound component, is able to regulate a sine-wave circulator with arbitrarily regulatory frequency component, arbitrarily regulatory amplitude or both. It is, in short, almost same apparatus as Embodiment 2, except that it is provided with a unit of amplifier 2 at the end of processing in said conversion means.

By using Embodiment 3 provided with amplifier 2, the amplitude of said output sound, which in practice virtually is the volume of said synthetic sound, would be under one's control. Now, one is able to regulate a sine-wave circulator with arbitrarily regulatory frequency component and arbitrarily regulatory amplitude as one wants.

Embodiment 4

<Additive Synthesis, Circulator Regulation Apparatus, Arbitrarily Regulatory Frequency Component, Arbitrarily Regulatory Amplitude>

Figure 16:
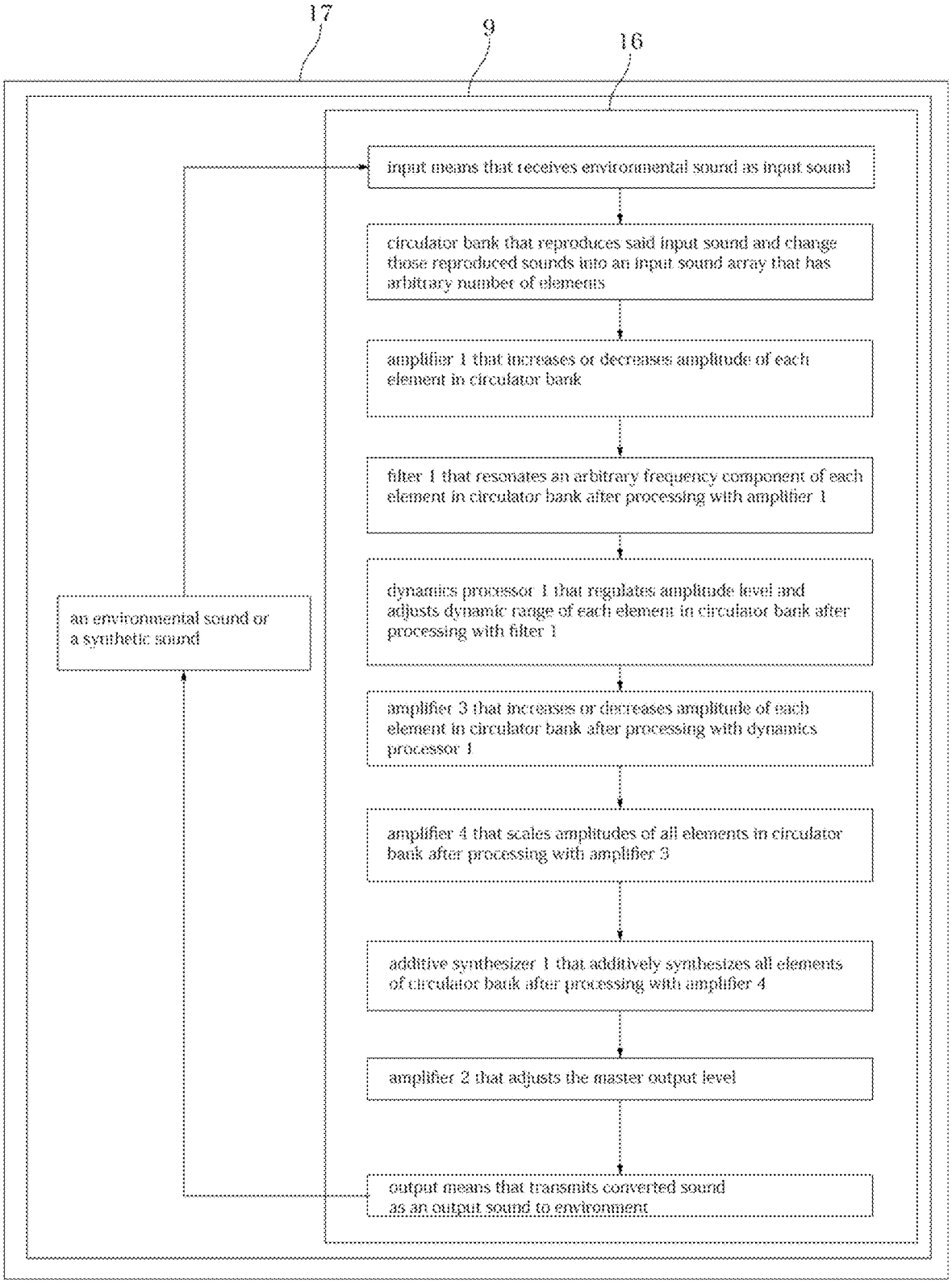
FIG. 16 shows a system block diagram of the sound regulation apparatus in examples of the present disclosure.
Figure 17:
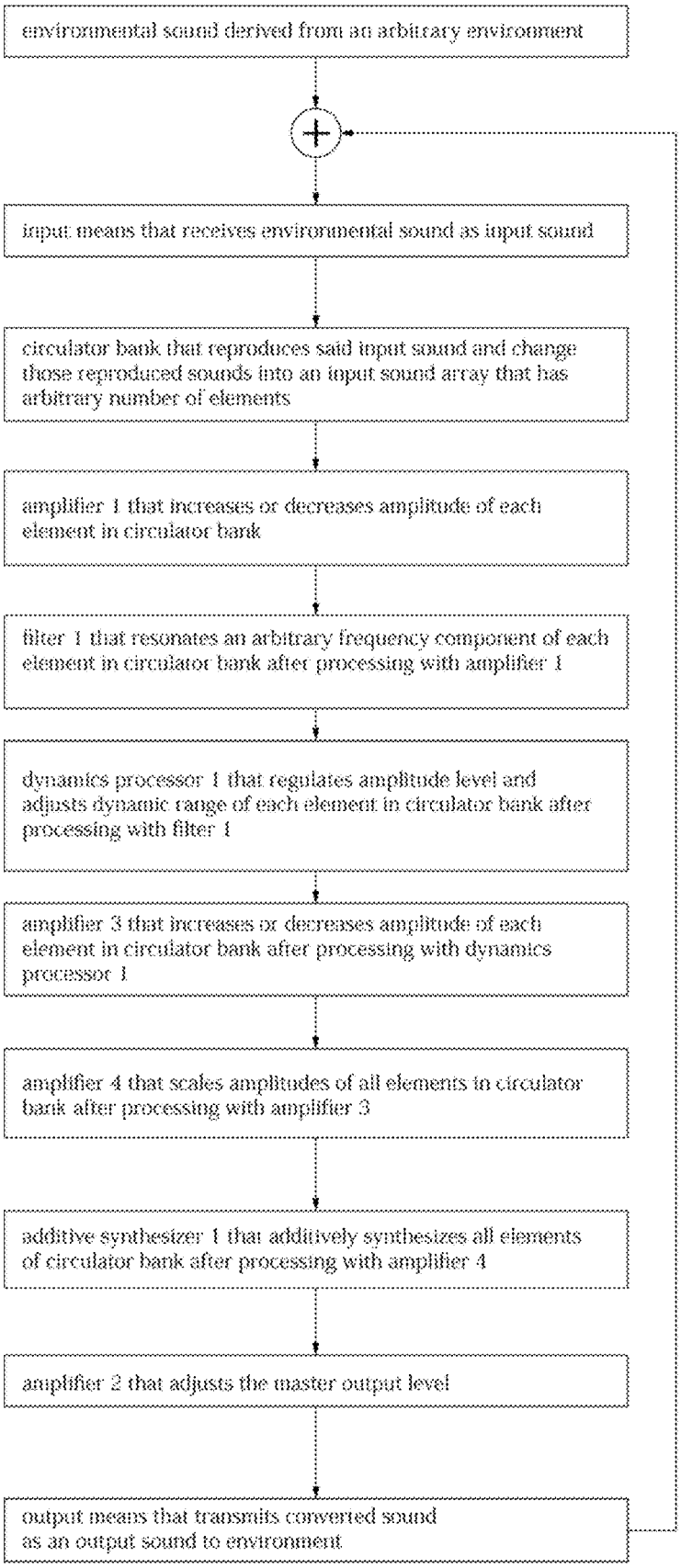
FIG. 17 shows a flow chart of the sound regulation apparatus in examples of the present disclosure.
Figure 18:
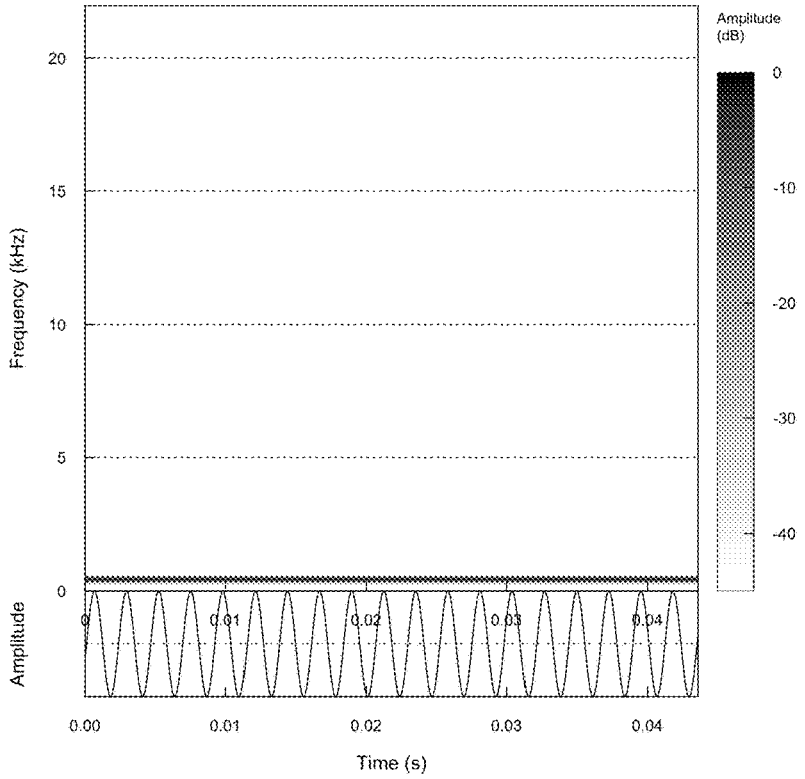
FIG. 18 Oscillogram and spectrogram of a sine-wave circulator (horizontal axis is time, and vertical axis is amplitude or frequency, generally, how to read plot is same in other plots).
Figure 19:
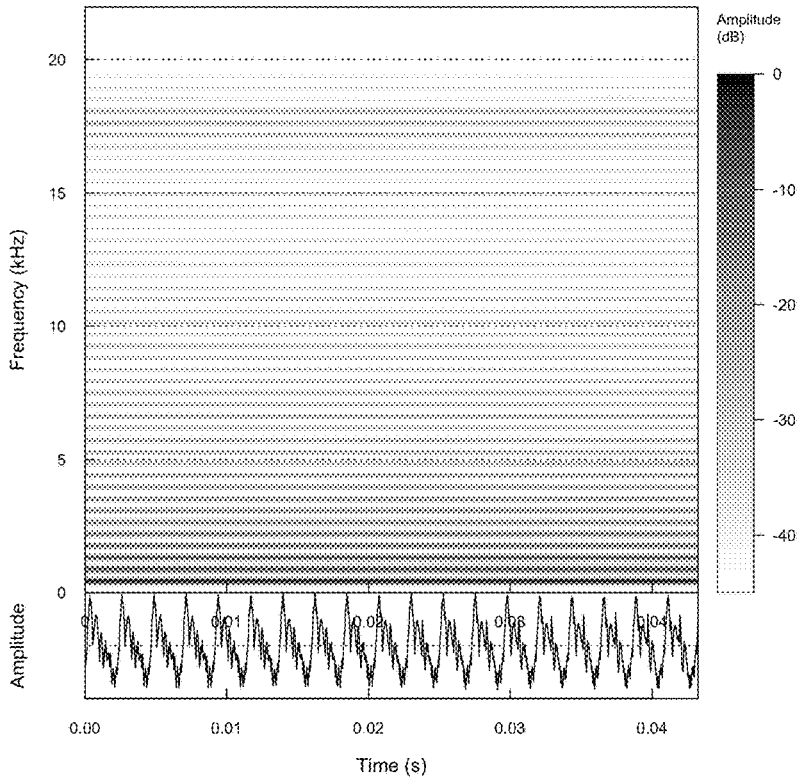
FIG. 19 Oscillogram and spectrogram of a sawtooth-wave circulator.
Figure 20:
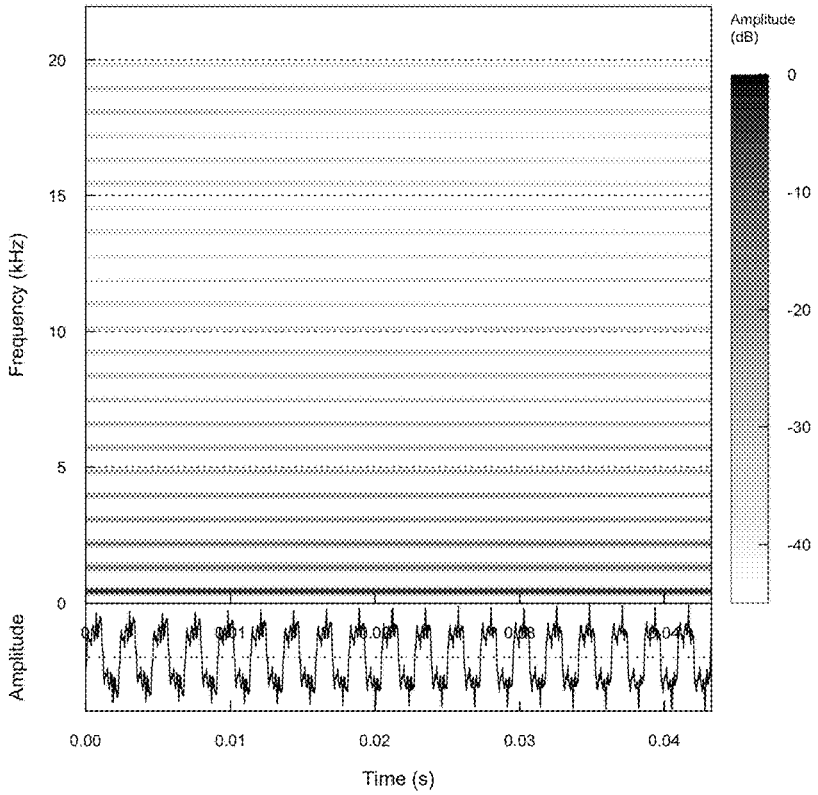
FIG. 20 Oscillogram and spectrogram of a square-wave circulator.
Figure 21:
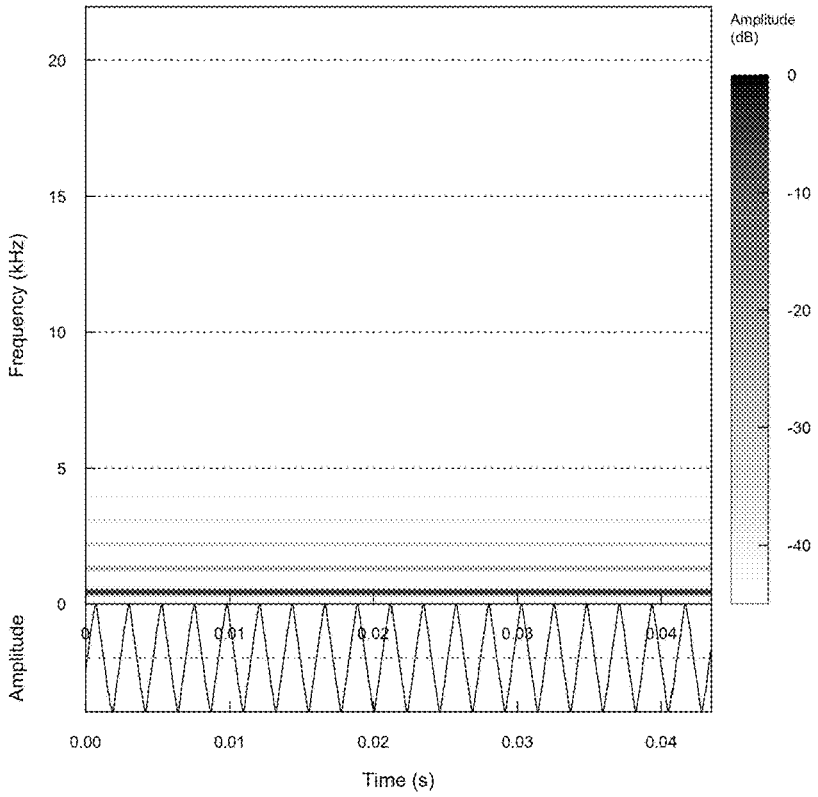
FIG. 21 Oscillogram and spectrogram of a triangle-wave circulator.
Figure 22:
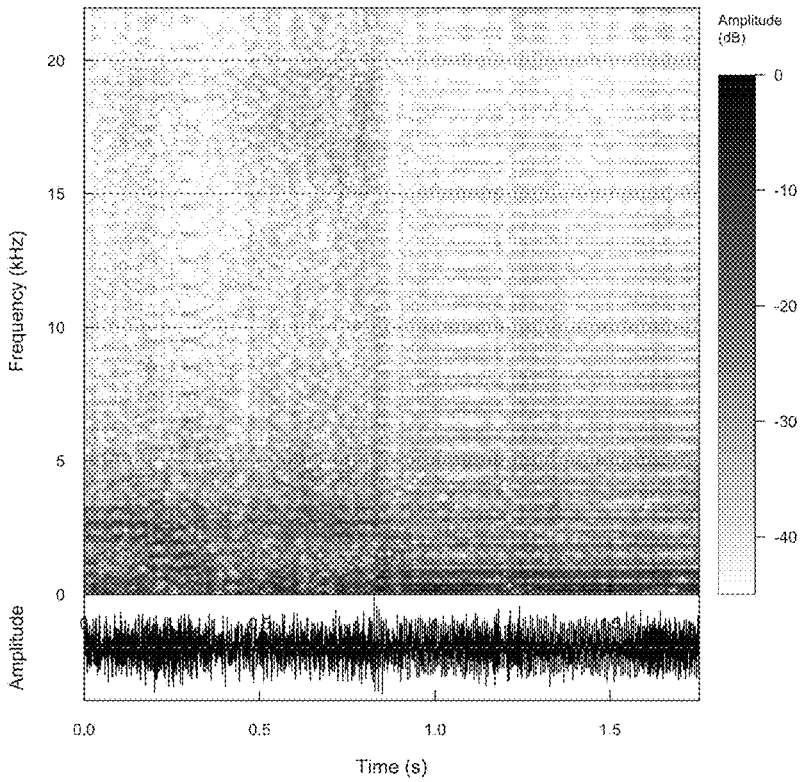
FIG. 22 Oscillogram and spectrogram of a prototype of square-wave circulator, where frequency components are not regulated.

Embodiment 4 is explained in this section. It is an apparatus that is able to execute additive synthesis processing based on elements of a circulator bank that comprises one or more sine-wave circulators with arbitrarily regulatory frequency component, arbitrarily regulatory amplitude or both. With Embodiment 4, one is able to regulate circulators with arbitrary sound component, e.g. circulators comprising: components approximating to a principle oscillator such as sawtooth-wave, unnatural components, noisy components, etc. As with Embodiment 3, Embodiment 4 is able to control amplitude as well. For the system block diagram and flowchart, see FIG. 16-17.

Embodiment 4 is subject to Embodiment 1, but, as with previous embodiments, the process within said conversion means is different. In the following paragraph, process after receiving said input sound is described.

Embodiment 4 has a circulator bank that reproduces said input sound as many as user wants and keeps said reproduced input sounds as the elements of said circulator bank. That is, with said circulator bank, one is able to regulate an array of said input sound, in which respective elements holds sine-wave circulators with arbitrarily regulatory frequency component, arbitrarily regulatory amplitude or both. Amplitude of each element in said circulator bank may be increased or decreased to arbitrary degrees with amplifier 1 of each element (without particular note, as with amplifier 1, each element in a circulator bank is provided with other units too). After amplifier 1, each element in said circulator bank is filtered with filter 1, resonating an arbitrarily regulatory frequency component. After filter 1, dynamic range and amplitude of each element may be adjusted and regulated with dynamics processor 1 e.g. adding limiter effect.

Then, amplifier 3 adjusts amplitude of each element in said circulator bank. Basic purpose of using amplifier 3 is, but is not limited to, adjustment of amplitude of the fundamental and harmonics of a circulator being regulated. Accordingly, amplitude 3 may be used to adjust amplitude of each element regularly or irregularly as one wants. For example, one is able to compose a circulator bank that amplitudes of elements are gradually increasing, a circulator bank that amplitudes of elements are gradually increasing and decreasing like mountains, etc.

Then, with amplifier 4, amplitudes of all elements of said circulator bank are scaled. Basic purpose of using amplifier 4 is, but is not limited to, preventing clipping of circulator sound level that might be caused in practice by the increment of amplitude after the additive synthesis processing in the next processing.

Then, with additive synthesizer 1, all elements in said circulator bank are additively synthesized. Until this processing, adjustment of both regulatory frequency components and regulatory amplitudes has been done already, and scaling has been done too. Accordingly, values of frequency components and their amplitudes are not unpredictable, and thus it is expected that clipping will not occur too. That is, until this additive synthesis processing, it may be thought to be certain that regulatory frequency of each element in said circulator bank is arbitrary value or default, and the sum of regulatory amplitudes of all elements is 1.0 or less then 1.0.

Then, with amplifier 2, if necessary, the master output level or volume of said output sound is adjusted to arbitrary value.

In the next embodiment of Embodiment 5, how to compose a sawtooth-wave circulator that the fundamental is 220 Hz and amplitude is 0.5 is explained.

By the way, the additive synthesis method described above as the Embodiment 4 might appear seemingly similar to the additive synthesis method written in Dobson (2011): a method that, after preparing a sine-wave oscillator bank, sine-wave oscillators in said oscillator bank are additively synthesized, generating e.g. sawtooth-wave oscillator as a result. However, the method of Embodiment 4 (that carries out subtractive synthesis process of environmental sound, said additive synthesis process or both of them) and the method written in Dobson (2011) (that generates oscillators generated from electronic device or circuit) are, needless to say, not the same at all in terms of concrete processes, functions and units used. To be specific, oscillators are neither a sound derived from natural oscillation nor a sound with fluctuating frequency component and fluctuating amplitude being non-linear like circulators.

Embodiment 5

<Additive Synthesis, Sawtooth-Wave Circulator Regulation Apparatus, Arbitrarily Regulatory Frequency Component, Arbitrarily Regulatory Amplitude>

As Embodiment 5, based on Embodiment 4, regulatory process of a sawtooth-wave circulator with amplitude set to 0.5 and the fundamental set to 220 Hz is explained. For the system block diagram and flow chart, see FIG. 16-17.

First, how to regulate the fundamental and harmonics of a sawtooth-wave circulator is explained. The fundamental frequency of said sawtooth-wave circulator corresponds to the pole frequency of filter 1 belongs to a sine-wave circulator assigned to the first element in a circulator bank. Harmonic frequencies correspond to the pole frequencies of filter 1 that belongs to respective sine-wave circulators assigned to the second element and after in a circulator bank. Accordingly, for composing a sawtooth-wave circulator, one has to prepare a circulator bank with those regulatory frequency components, to adjust amplitudes of respective elements in said circulator bank, and to carry out the additive synthesis of all elements in said circulator bank.

Harmonic frequencies of a sawtooth-wave are thought to respectively be natural number times the fundamental frequency (i.e. first element is 1 times the fundamental, second is twice, third is 3 times and so on). Accordingly, when 220 Hz sawtooth-wave circulator is regulated, the fundamental frequency (220 Hz) is assigned to said pole frequency of the first element in said circulator bank, and harmonics frequencies (440 Hz, 660 Hz and so on) are assigned to said pole frequencies of the second element and after.

However, currently amplitudes of all elements remain to be 1.0 or default. Accordingly, as harmonic amplitudes of a sawtooth-wave oscillator gradually decrease, harmonic amplitudes of a sawtooth-wave circulator may be decreased as well. Amplitudes of harmonics and the fundamental of a sawtooth-wave may be thought to be decreasing by the inverse of the harmonic series (i.e. 1, ½, ⅓, etc.). Thus, based on the inverse of harmonic series, regulatory amplitude of each element in said circulator bank may be adjusted separately with amplifier 3 (i.e. 1, ½, ⅓, etc.). With this process, amplitude of harmonics and the fundamental of a sawtooth-wave circulator shall be adjusted properly. (By the way, if each amplitude value is inversed, ramp of regulated sawtooth-wave is inversed.)

However, if additive synthesis is carried out based on the current circulator bank, it may be expected to produce clipping as a result. Accordingly, in addition, amplitudes of all elements in said circulator bank must be scaled with amplifier 4 so that the sum of all amplitudes is 1.0 or less than 1.0. With these processes above, now initialization of said circulator bank is done.

Subsequently, with additive synthesizer 1, said circulator bank is to be synthesized as a whole.

In addition, for fulfilling said requirements of Embodiment 5, amplitude of output sound is set to 0.5 with amplifier 2.

Based on those processes, one has now successfully accomplished the preparation for regulating a sawtooth-wave circulator that amplitude is 0.5 and the fundamental is 220 Hz. By applying this Embodiment 5, it is also possible to regulate circulator with square-wave, triangle-wave, unnatural components, noisy components, etc.

Embodiments 1-5 described here that those Embodiments are based are the primary embodiment of the invention. From Embodiment 6 in the next section, on potential of the primary embodiment, outlook, supplementary discussions and so on will be described.

Embodiment 6

A circulator regulation method.

Embodiment 7

A sine-wave circulator regulation method.

Embodiment 8

A circulator regulation method.

Embodiment 9

A circulator regulation program.

Embodiment 10

A sine-wave circulator regulation program.

Embodiment 11

A circulator regulation program.

Embodiment 12

Significance thought of the invention would exist in a point that the invention may be interpreted as an interactive system working with an environment. In other words, when one composes a sound or musical sound using of the invention, one is able to take account of the regulation of or by environment (to be specific, environmental transformation and its natural oscillation), in addition to the regulatory system of the invention itself or its embodiment. For instance, with the invention, one is able to re-construct the sound regulation apparatuses written in Misawa (2016) that synthesizes, or give rise to, an environmental behavior comprising person, artifact, culturality expressed, etc.

Embodiment 13

By providing arbitrary culturality as a factor for an interaction design between environment and the invention, one may in practice regulate interaction intensities (see Misawa (2014, 2016) for the interaction design to control interaction intensity by regulating person behavior for singing or karaoke). Said interaction intensity may be interpreted from plots visualizing sound recording as well as behavioral observation via ethnography, etc. For example, changes of interaction intensity may be interpreted from spectrogram or oscillogram (see FIG. 25).

Concrete method for intensifying interaction intensities may be, for instance, a method that carries out analysis, synthesis or both of emergent interaction using culturality as a factor. This is, in other words, to carry out culturality analysis based on observation, and to carry out culturality synthesis through apparatus design based on the result of said culturality analysis; it is to carry out a research of culturalities as a research method of interactions or more generally to carry out a type of emergent interaction design research that focuses on, in addition to apparatus, environmental factor that seem to in practice be functioning or synthesized into an emergent interaction, such as culturality.

Designing apparatuses that use culturality as a factor might be something impose positive (evidence-based or demonstrative) and historical design to designers. This means that to carry out culturalities might become a burden to existing designers. However, it might be noted at the same time that the whole picture or significance of the research of culturalities is, needless to say, not clear yet.

To design interactions regulating culturality as a factor means in practice that one is to regulate or apply, in designing interactions, three types of culturality provisionally defined in Misawa (2016): referential culturality that is a behavior referring to a mode seems to be traditional, analogous culturality that is a behavior analogous to a mode seems to be traditional and habitual culturality that is a behavior seems to be a mode habitually practiced (for further information, see Misawa (2016)).

This type of interaction design is not something to design "interaction" that is focused nearly only on apparatus design, but is something that literally or thoroughly carry out designing inter-actions, or cooperative agency, as possible as one can; in other words, this type of interaction design may take a form of e.g. an emergent interaction design that uses culturality as an environmental factor.

As far as circulator is regulated, in applications, size, form, composition, musical genre and so on of Embodiment 13 are unconditional or arbitrary. It does not matter if Embodiment 13 or the invention is applied or used based on a scale of performing arts, society, culture, universe, handheld device like smartphone or something smaller.

Embodiment 14

Embodiment 14 is an embodiment of the invention that regulates a sound with varied fluctuations intentionally. Fluctuation contained in a circulator is constantly transforming due to its use of environment as the sound source (that is, natural oscillation caused by environmental transformation), whereby Embodiment 14's sound or timbre is a different than other existing technologies' sounds such as vibrato and signal modulation technique (namely, artificial manipulation of acoustic instrument sound, analog oscillator sound, digital oscillator sound, etc.).

For example, in a silent environment like recording studio, circulators may have relatively static fluctuations; in a loud environment such as public space with much traffic, circulators may have relatively dynamic fluctuations. These fluctuations are natural ones, and thus different than artificial analog or digital oscillator sound or its modulated sound. Accordingly, when one uses Embodiment 14, one is able to take account of what kind of environmental behavior or environmental transformation should be regulated as a factor in circulator design, musical sound composition, etc. For instance, a dormant culturality that will be active and regulated later on in an environment may be such a factor, e.g. Japanese annual tradition or behavior called hatsumoude. See FIG. 22, for the spectrogram and oscillogram of a circulator synthesized with the sound components originates in hatsumoude. This audio recording was actually recorded live at a Buddhist temple on the New Year's Eve in 2016, Japan.

Embodiment 15

If applied environment is a natural environment, rather than a closed room or artificial environment, an environmental sound (of which emerging bandwidth of frequency components is relatively wider) and a converted sound (of which emerging bandwidth of regulatory frequency components is relatively narrower) may be synthesized into a circulator sound, or a synthetic sound. This sound is something that would contain frequency components of both said environmental sound and said converted sounds; that is, the sound in practice is synthesized with arbitrarily regulatory components artificially defined by user AND naturally fluctuating component caused by environmental transformation e.g. languages spoken, emergence of the four seasons, emergence of hatsumoude, emergence of Christmas, emergence of other culturality expressions and so on.

Embodiment 16

Embodiment 16 is all other potential embodiments that may be a contribution to: designing interaction between person and artifact, human-computer interaction, transcultural studies, art, politics, etc. Those contributions, needless to say, relates also to making: musical instrument, background music, written or sounding music, space design, architecture, artificial reality, virtual reality, 3D user-interface, entertainment, artwork, etc.

REFERENCE SIGNS LIST

1 Environmental sound.
2 Microphone.
3 Ground.
4 Sound regulation apparatus, etc. (the invention)
5 Cable.
6 Stand for microphone or loudspeaker.
7 Loudspeaker.
8 Output sound, synthetic sound or both.
9 Circulator.
10 Person carrying out circulator regulation using circulator controller like a flute.
11 Circulator controller like a flute.
12 Person carrying out circulator regulation using circulator controller like a keyboard instrument.
13 Circulator controller like a keyboard instrument.
14 Person carrying out circulator regulation by dancing that is a physical expression interfering in environmental sound.
15 Interface as an ideal boundary.
16 System of sound regulation apparatus, etc. (the invention system)
17 Environment system.
18 Embodiment of the invention.
19 Person carrying out circulator regulation by singing that is a physical expression interfering in environmental sound.

Additional Explanation of Figures

FIG. 1

Environment system may include people, artifacts, their behavior and so on; it is an ecosystem that is intermediated one another with sound, where the invention system, precisely, is one of the factors (for definition of environment, see Explanation of Terms section). The invention system may include the invention itself, input/output means, their behavior and so on that are intermediated one another with e.g. electric signal or sound signal. As interaction become manifest between said environmental system and said invention system, a sound or its signal is to circulate between them, causing a circulator as an emergent behavior (see the circular arrow in FIG. 1).

FIG. 7

This shows circulatory sound flow of a circulator that is written with circular arrow, where an environmental sound caused by an environment transforms, via input means, conversion means and output means, into an output sound or synthetic sound, and then is received again via said input means and converted further.

FIG. 8

This shows, from left: players of keyboard-type controller, player of flute-type controller, singer and dancer. Presence and behavior of those players work in practice as regulators of synthetic sound. For instance, singer and dancer are able to control or regulate synthetic sound with their physical movement.

FIG. 10

This shows an embodiment like a smart phone, smart speaker, portable music player, wearable or ubiquitous computing device, etc. An arbitrary environment may be furnished with this embodiment. One is also able to wear or go with it, like a fieldwork or field-recording.

FIG. 11

This shows overview of the principle circulator regulation processes. For instance, circulatory process of a circulator in an environment comprises a series of metamorphoses of environmental sound, transforming into e.g. input sound, converted sound, output sound and synthetic sound. Said environmental sound may, concretely, transform into a sine-wave circulator, element(s) in circulator bank, additively synthesized sound, square-wave circulator and so on. Process of plus symbol (+) written in said circulatory process represents a synthesis processing of said synthetic sound with said environmental sound and said output sound. However, said synthesis processing is not necessarily an additive processing in practice. This may also be subtractive one, etc. For example, if person interferes in microphone covering its sonic sensor with hand and reducing some intensity or components of its input sound, the resulting sound after said synthesis processing may become soften or lowly intense naturally in the next moment.

FIG. 12, 14, 16

Respectively, these Figures are not flow charts but the system block diagrams.

FIG. 13, 15, 17

Respectively, these Figures are not system block diagrams but the flow charts. Process of plus symbol (+) represents a synthesis processing of said synthetic sound, but, as with FIG. 11, said synthesis processing is not necessarily an additive synthesis in practice, but also may be subtractive one, etc.

FIG. 18

Spectrogram and oscilloscope of a sine-wave circulator. Vertical axis of said spectrogram shows frequency components from 20 Hz to 22.5 kHz. Vertical axis of said oscilloscope shows amplitude. Horizontal axis in both shows the time advance in second. How to read spectrogram and oscilloscope is same in the other Figures with spectrograms or oscilloscopes.

FIG. 22

Spectrogram and oscilloscope of a prototype of square-wave circulator (hereafter, proto-circulator), where frequency components are not regulated (that is, amplitudes of all frequency components are manifestly present). About or after 0.8 second, amplitudes of some frequency components of said proto-circulator are increasing, forming a certain regular or periodic patterns. Those new patterns are an emergent sound of circulator synthesized with the sound of joyanokane accompanied by hatsumoude. That is, this plot of said proto-circulator contains a sonic behavior that is called joyanokane and relating to a Japanese New Year celebration behavior called hatsumoude; this is a sound of a culturality expressed. Recording of this began around 23 o'clock in the New Year's Eve at Buddhist temple in 2016 through the beginning of 2017, and was continued for an hour by the inventor himself who predicted before this recording "as in last year, behavior of 'hatsumoude' will probably be demonstrated again." As this plot may be a piece of evidence, said annual culturality of hatsumoude was eventually demonstrated and synthesized into the regulated proto-circulator successfully.

FIG. 23-24

Spectrogram (FIG. 23) and frequency spectrum (FIG. 24) of a circulator with unnatural regulatory frequency components and amplitude. Said regulatory frequency components are 22000 Hz, 8800 and 4400. 22000 Hz component is not clearly visible but is plotted at the top edge in FIG. 23, right edge in FIG. 24.

FIG. 25

Figure 23:
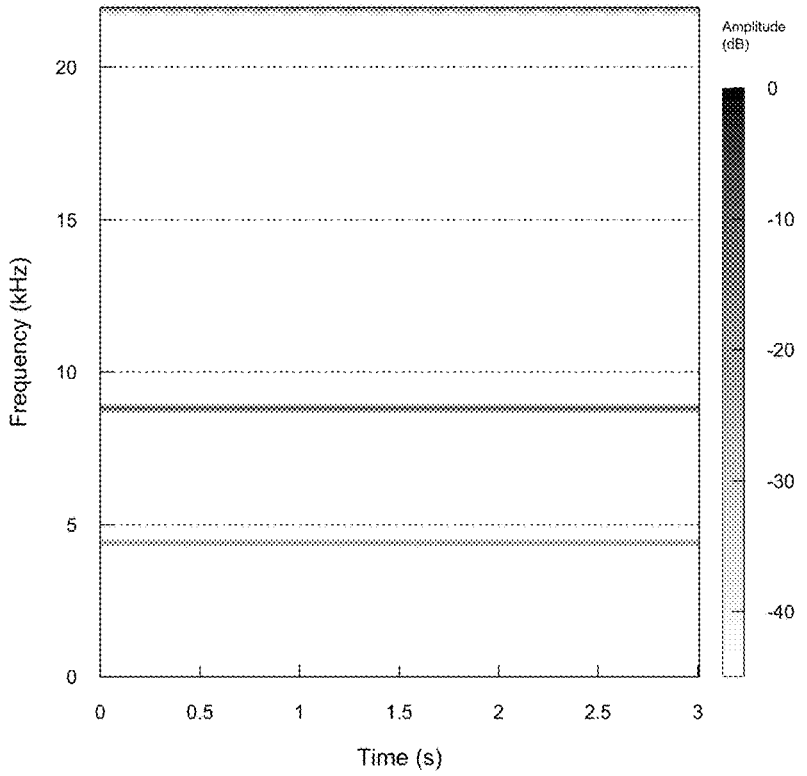
FIG. 23 Spectrogram of a circulator with irregular regulatory amplitudes and unnatural regulatory frequency components (from top: 22000 Hz, 8800 and 4400).

Same oscillogram and spectrogram as FIG. 23, except the manifest environmental sounds contained in it (from left: person voice, person whistle 1, person whistle 2 and person clap). Those are manifest sound components caused by environment. If the threshold of said plot is set to lower degrees, latent sound components become more manifest or emerging relatively. Amplitude after 6 seconds is dynamically fluctuating due to interactions between said person clap as an environmental sound and the invention that is processing circulator.

FIGS. 26A, 26B, 26C and 26D

Oscilloscope plots of sine-wave circulator (26A), saw-tooth-wave (26B), square-wave (26C) and triangle-wave (26D)

Explanation of Terms

Some terms used in the Specification is explained below.

<(The) Invention>

Without particular note, it means Claims, Embodiments or both of them.

<Environment>

The ten thousand things or everything that are or is constituting the cosmic or the universe. As time advances, natural oscillation caused by movement or transformation of environment may be constantly observed (behavior of person or artifact is interpreted as part of the cause of natural oscillation, in this Specification). An environment also includes the behavior that is dormant when one starts to use the invention or its embodiment and will be active at some point in the future (e.g. natural oscillation caused by hatsumoude, etc.). For effective description of the invention, definition of environment usually does not include the invention system itself including input/output means, as far as the invention itself is described or discussed. However, in terms of original definition of environment, it includes the invention system as an interacting factor in the ecosystem as environment; not to mention, it includes persons as well. That is, although in description of the invention an environment excludes the invention system including input/output means, practical or precise meaning of environment basically depends on the descriptive context. An embodiment of environment may be a place around the invention that is not far away. It may be silent place like an audio recording studio, noisy place like street in the public, concert hall, art gallery and so on. That is, an environment may be any arbitrary place that is furnished with the invention. As one would notice, based on this meaning of environment, an environment may potentially be the outer space as well. However, without particular note, environment usually means a place with the air on Earth that sonic waves are propagating. Similarly, an environment in the distance streaming its noise via the Internet may be an environment in terms of the definition, but, without particular note, an environment basically is not such a place in the distance too. An environment normally is a location around the invention with the air on Earth, in the Specification.

<Hatsumoude>

A behavior by the Japanese that is seemingly traditional or periodic. It celebrates the advent of the New Year and particularly waxes symbolic from the evening of the New Year's Eve through the beginning of the New Year. This behavior often accompanies a series of events, such as joyanokane: 108-times tolling of temple-bell that begins around the midnight. Joyanokane may usually be heard together with the enthusiasm of people getting along, drinking Japanese wine, having traditional noodles or doing countdown towards the midnight: resonance of joyanokane accompanied by hatsumoude.

<Environmental Sound>

Air vibration or sonic wave that is caused by natural oscillation of an environment. It usually is fluctuating, and may include a sound that is dormant when one starts to use the invention or its embodiment and will be active at some point in the future (e.g. sound of natural oscillation caused by hatsumoude, etc.).

<Circulator>

Sound that is regulated by the invention, and has arbitrarily regulatory frequency components, arbitrarily regulatory amplitude or both of them, and uses the environment as the sound source. It may also be interpreted as an embodiment of an ideal notion of interface, because circulator is emergent behavior between an environment and the invention interacting with both of those; in other words, circulator, when it is emerging, is that which is circulating between those beings, being regulated by those. Like a sonic mirror, it reflects environment with sound.

<Component>

As far as the context discussed is concerned with sound regulation or the invention, it means frequency component.

<Circulator Frequency Component>

Frequency component of a circulator regulated by the invention. It in practice is a frequency component of synthetic sound; that is, frequency component that is synthesized with regulatory frequency component and (the present) environmental frequency component. For instance, circulator frequency component may be a component of tuned sound constituting arbitrary musical scale, of unnatural sound, noisy sound, etc.

In addition, due to use of environment as the sound source, circulator frequency component constantly transforms or fluctuates in response to environmental transformation around the invention. Whether said transformation is static or dynamic depends on environmental behavior used. For instance, it may have a statically fluctuating component in a static environment or a dynamically fluctuating component in a dynamic environment.

Figure 24:
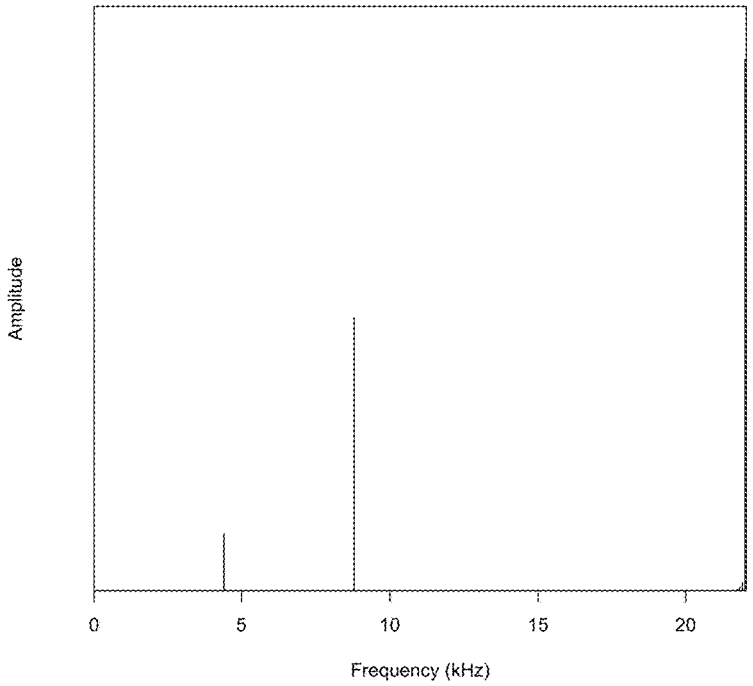
FIG. 24 Frequency spectrum of the circulator of FIG. 23.
Figure 25:
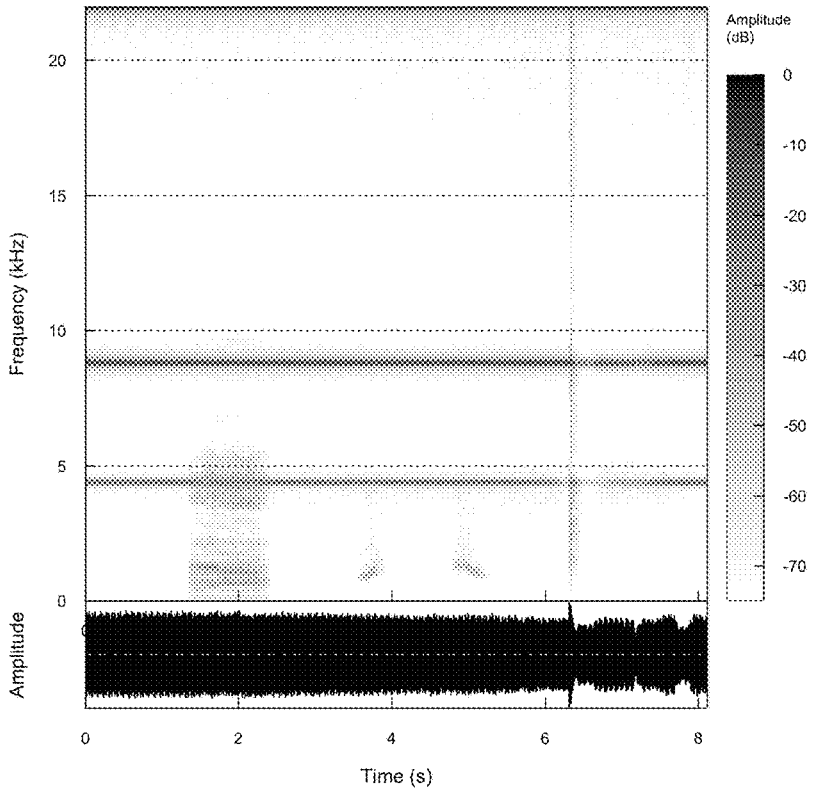
FIG. 25 Oscillogram and spectrogram of the circulator of FIG. 23 synthesized simultaneously with manifest environmental sounds (from left: person voice, person whistle 1, person whistle 2 and person clap).
Figure 26A:
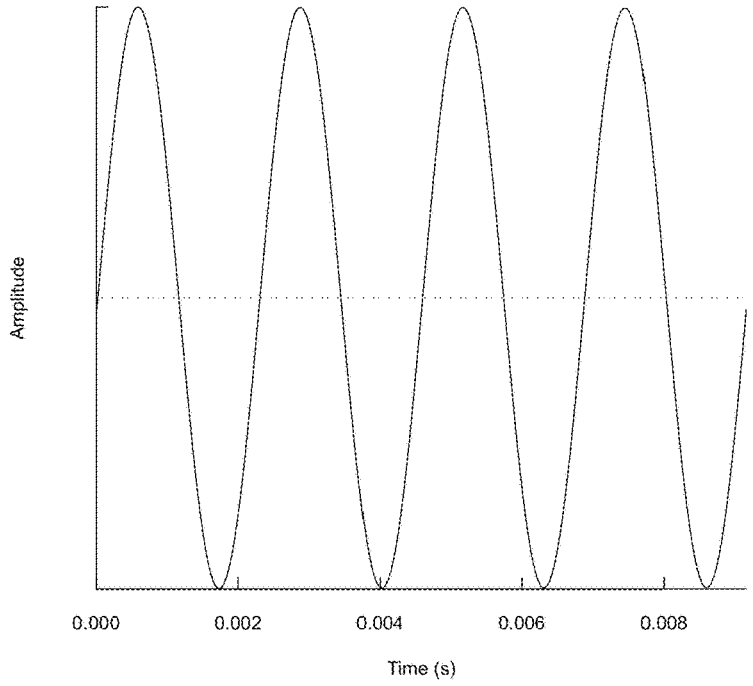
FIGS. 26A, 26B, 26C and 26D Oscillograms of principle circulators (26A is sine-wave circulator; 26B is sawtooth-wave circulator; 26C is square-wave circulator; and 26D is triangle-wave circulator)
Figure 26B:
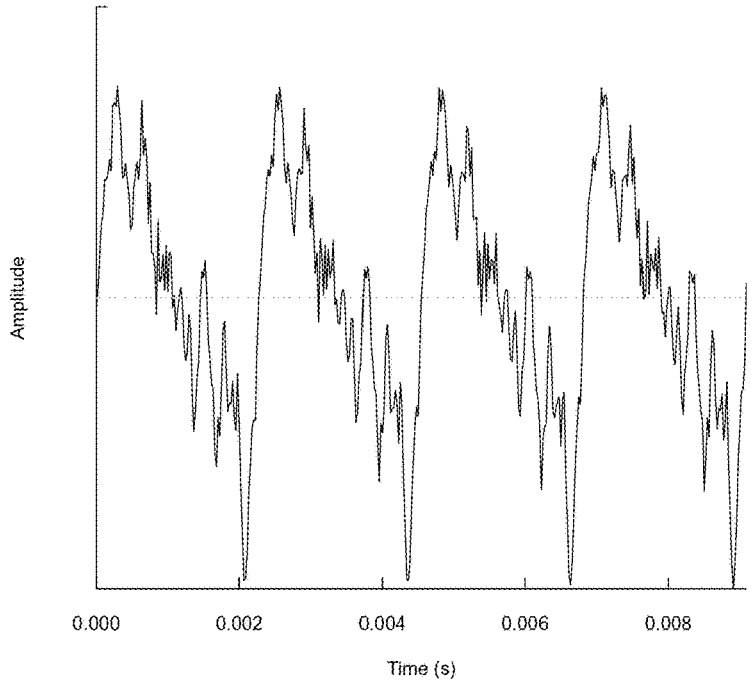
Figure 26C:
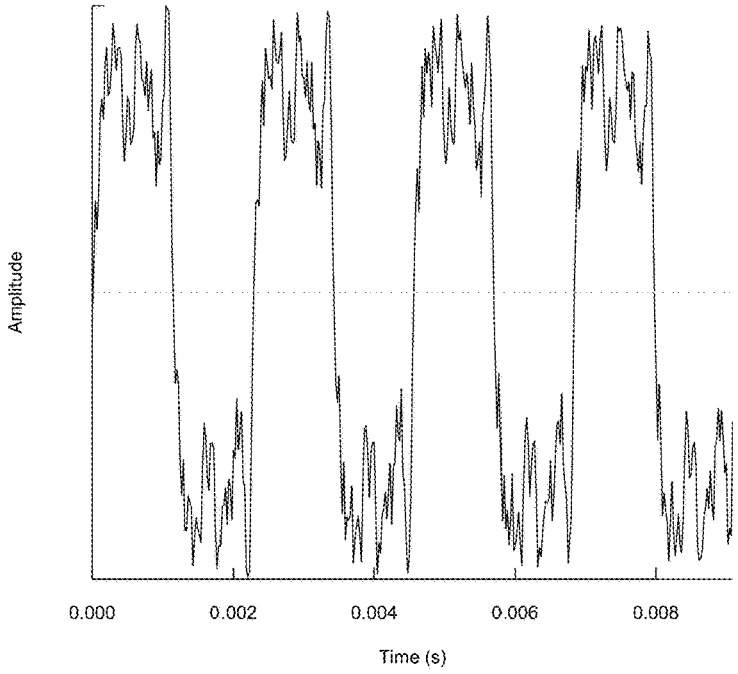
Figure 26D:
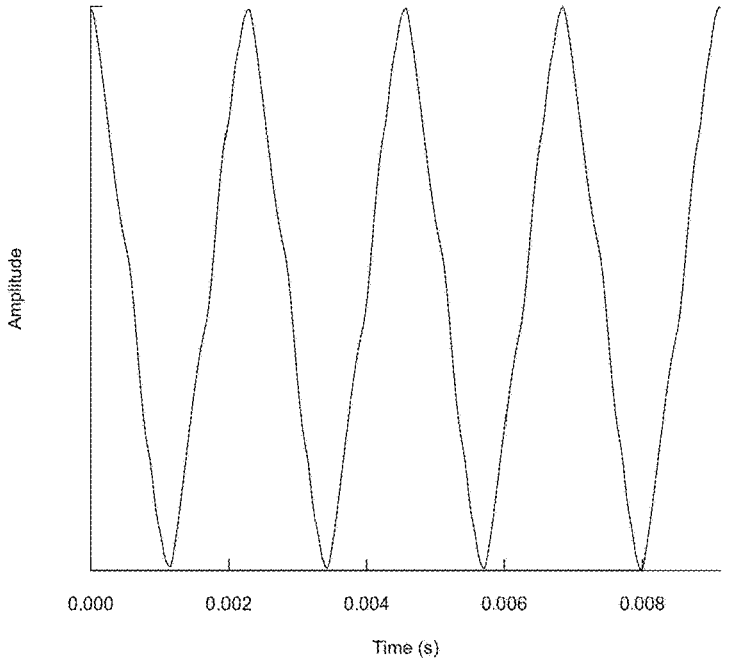

Circulator may emerge even in a very silent environment like recording studio e.g. as a sine-wave circulator with the fundamental of 22000 Hz (see FIGS. 23-25).

<Listener>

Part or factor of an environment as ecosystem. In embodiment of the invention, a listener who listens to the invention actually has already been working as a player or regulator of circulator without doing anything (listener's physical presence itself affects not a little the component or amplitude of a circulator being emergent). As time advances, listeners can transform themselves into others as actors, or can do any behavior additionally such as culturality expression.

<Oscillator>

Sound that is not abstracted from environment and is usually generated from electronic circuit or digital processing. Oscillator's component and amplitude are neither fluctuating nor non-linear like circulator's. Oscillator basically has the determinate behavior and may not give rise to any emergence of circulatory sound nor the continuity via interactions between environment and oscillator generator.

<Environmental Frequency Component>

Frequency component of an environmental sound at some point of time.

<Environmental Amplitude>

Amplitude of an environmental sound at some point of time.

<Regulatory Frequency Component>

Frequency that the invention uses as a standard for regulating input sound in conversion means at some point of time.

<Regulatory Amplitude>

Amplitude that the invention uses as a standard for regulating input sound in conversion means at some point of time.

<Interaction>

Behavior being done between two.

<Ecosystem>

Pluralism of said interaction.

<Interface>

Boundary between two.

<Emergent Interaction>

Emergent behavior that seems to be actually being done between two.

<Culturality>

Behavior that is seemingly symbolic (traditional or periodic) to an arbitrary point of view of an analyst; it is, in other words, an interpretation about an emergent interaction, etc. For instance, a behavior may be interpreted to be "the four seasons," "Japanese way of greeting (bow)," "voicing (language or mother tongue)" and so on. For further information, see Misawa (2016).

<Culturalities:>

Research or study on culturality, which carries out synthesis, analysis or both of culturality; works that are done for any culturality regulations. It relates, basically, to environment-apparatus interaction design, etc.

<Input Means>

Means for converting an environmental sound into an input sound to conversion means. It may in practice be a sound card (audio interface), AD (analog to digital) converter, etc. The number of microphones and the like connected to an input means is arbitrary.

<Input Sound>

Environmental sound that input means has received. It may be interpreted as an audio signal converted with AD converter, for instance.

<Circulator Bank>

Input sound array that has an input sound, or circulator in practice, as an element.

<Conversion Means>

Means to convert an input sound into a converted sound. In application, this may be an embodiment like a laptop computer, desktop, mobile, handheld, earphone, wearable, embedded, ubiquitous, etc. Computer here means varied embodiments of computing device provided e.g. with memory, hard-drive, CPU, input/output interface, etc. A computer also may include user-interface, such as keyboard, screen, mouse, etc. In a nutshell, a computer is a system for computing (e.g. circulator regulation) that users can use without particular difficulties, where computer design itself is unconditioned.

Computer in this sense must somehow acquire an input means and an output means, for embodying the invention. For instance, if a computer already were to have essential functions of sound card including AD or DA conversion, input/output interface, etc., it would not have to add additionally input means and output means. However if it does not, said computer would have to add those means.

For controlling quality of circulator such as frequency bandwidth, it would be convenient to use a laptop computer and a sound card. However, if an application would not have to pursue such sound quality, it would be able to use a computer that input/output means are embedded within somehow, such as smartphone. Regardless of the practical forms of embodiment, it is expected that the timbre of circulator regulated and emerging will be adaptive to environment and intriguing to listeners, reflecting quality or factors of said environment: frequency bandwidth or bit-depth of input/conversion/output means, emergent interaction, culturality expressed, etc. (For a plot of circulator synthesized with emergent interaction and culturality, see FIG. 22.)

<Converted Sound>

Input sound that is converted into a sound with regulatory frequency component, regulatory amplitude or both. Frequency component of a converted sound may approximate, but not be limited, to the frequency component of a principle waveform e.g. sine-wave, sawtooth-wave, square-wave or triangle-wave. A converted sound may be a musical sound constituting an arbitrary musical scale as well, whether it is equal temperament or just intonation. It may also be other arbitrary sounds like noise, etc.

For instance, when a conversion means converts an input sound into a sawtooth-wave that regulatory frequency (the fundamental) is 1000 Hz and regulatory amplitude is 0.9 as the regulatory standard, this conversion means tries to convert said input sound into a converted sound of sawtooth-wave with regulatory frequency of 1000 Hz and regulatory amplitude of 0.9, and also it in fact maintains part of the original frequency component and original amplitude of the said input sound. As a result, those factors are synthesized into one converted sound.

That is, said converted sound of sawtooth-wave with the fundamental set to 1000 Hz and amplitude set to 0.9 is not a literally linear sound with sawtooth-waveform, the fundamental as 1000 Hz and amplitude as 0.9, but a sound that is approximating to sawtooth-wave with the fundamental as 1000 Hz and amplitude as 0.9 and has simultaneously fluctuating components due to any sound caused by environmental transformation, or natural oscillation, such as hatsumoude.

In other words, in practice, frequency component and amplitude of a converted sound is determined not only by regulatory frequency component and regulatory amplitude in the invention, but also is regulated by frequency component and amplitude in an environment provided with the invention. Accordingly, frequency component and amplitude of the emergent sound caused by the invention-circulator—are something embodied based on how the environment-invention interaction actually works. Circulator, in a word, is not just a regulated sound, but a fruit of emergent interaction.

Therefore, if the invention were to be used in a static environment, converted sound would be expected to be a statically fluctuating converted sound, and in a dynamic environment a dynamically fluctuating one. Applying embodiments in an environment, one can, thus, observe that, while conversion means is trying to keep regulatory frequency component and regulatory amplitude, converted sound is actually and constantly being transformational and responsive to natural oscillation of the environment used (see FIG. 22, 25).

<Output Means>

Means for converting a converted sound into an output sound that is to be transmitted to environment. Its embodiment may be a sound card, DA (digital to analog) converter, etc. The number of loudspeakers and the like connected to output means is arbitrary.

<Output Sound>

Converted sound that is transformed through an output means, which may be interpreted as an electric signal that is converted with DA converter and is to be transmitted to environment.

<Synthetic Sound>

Sound in an environment synthesized with an environmental sound and an output sound. A synthetic sound may, generally, be a sound that is approximating to an additively synthesized sound that is synthesized with said environmental sound and said output sound. However, it may also be a subtractively synthesized sound, given potential human interference working as filter in a circulator. To be specific, if microphone or input means is covered with hands or the like, the resulting synthetic sound may be a kind of subtractively synthesized sound or less dramatic sound, due to interference in the circulator sound from output means through input means.

<Amplifier>

Generally, a regulatory unit in conversion means, which may increase or decrease the amplitude of a sound as much as one wants.

<Amplifier 1>

Amplifier unit, as a basic way to use, to increase amplitude of input sound. For instance, it may increase said amplitude 20 times or more. It would be also possible to write a program, etc. to automatically change the degrees of amplification like automatic gain-control, generative computer music, etc. If level of environmental sound were to be low level, adjustment or use of amplifier 1 would be thought to be essential.

<Amplifier 2>

Amplifier unit, as a basic way to use, to adjust amplitude of output sound that is transmitted from loudspeaker or the like. This works in practice as the master volume controller of output sound.

<Amplifier 3>

Amplifier unit embedded to each element in a circulator bank, which, as a basic way to use, adjusts the amplitude of said each element. It may adjust said amplitude regularly or irregularly, for instance.

<Amplifier 4>

Amplifier unit embedded to each element in a circulator bank, which, as a basic way to use, regularly adjusts amplitude of said each element for scaling the amplitude of all element in said circulator bank.

<Filter 1>

Filter unit, as a basic way to use, to abstract an arbitrary frequency component from an input sound, which may resonate arbitrary frequency component e.g. cut-off frequency component. To be specific, this regulates the fundamental of a sine-wave circulator, and may thus be a type of resonance filter.

<Dynamics Processor 1>

Dynamics processor unit, as a basic way to use, to adjust dynamic range and regulate amplitude of an input sound being processed. This may be, in practice, used as compressor effect or limiter, but may be used for other purposes too, such as distortion effector.

<Additive Synthesizer 1>

Synthesis unit in conversion means to carry out the additive sound synthesis of all elements in circulator bank.

CITATION LIST

Patent Literature

Non Patent Literature

Daichi Misawa, "Transparent Sculpture: an embodied auditory interface for sound sculpture," TEI '13 Proceedings of the 7th International Conference on Tangible, Embedded and Embodied Interaction, Pages 389-390, Barcelona, Spain, ACM New York, N.Y., USA, 2013.

Daichi Misawa, et al., "Data Auditorio: Towards intense interaction, an interactive super-directional sound for play and ubiquity," in Proceedings of ICMC-SMC-2014, pp. 1669-1676, International Computer Music Association, 2014.

Daichi Misawa, "Culturalities," Transactions of the Virtual Reality Society of Japan, Vol. 21, No. 3, 2016.

Richard Dobson, "Audio Programming in C," in Eds. Richard Boulanger and Victor Lazzarini, The Audio Programming Book, The MIT Press, Cambridge, Mass., London, England, 2011.

The invention claimed is:

1. A sound regulation apparatus for changing an environmental sound, the sound regulation apparatus comprising:

an input means that receives said environmental sound derived from an environment as a first input sound;

a conversion means that converts said first input sound into a first converted sound that contains a first regulated frequency component including a first frequency component that approximates to a first sine-wave oscillator, a first sawtooth-wave oscillator, a first square-wave oscillator or a first triangle-wave oscillator; or a first regulated amplitude; and an output means that transmits said first converted sound as a first output sound to said environment;

wherein said input means receives a second input sound that is a synthetic sound synthesized from said first output sound and said environmental sound; and wherein said conversion means converts said second input sound into a second converted sound that contains a second regulated frequency component including a second frequency component that approximates to a second sine-wave oscillator, a second sawtooth-wave oscillator, a second square-wave oscillator or a second triangle-wave oscillator; or a second regulated amplitude.

2. The sound regulation apparatus of claim 1, wherein said conversion means comprises:

a first amplifier that increases or decreases an amplitude of said first input sound; or said second input sound;

a first filter that resonates a first frequency component of a first sound derived from said first amplifier; or a second frequency component of a second sound derived from said first amplifier;

a first dynamics processor that regulates an amplitude level or adjusts a dynamic range of said first sound derived from said first filter; or said second sound derived from said first filter; and a second amplifier that adjusts a master output level of said first converted sound; or said second converted sound.

3. The sound regulation apparatus of claim 1, wherein said conversion means comprises:

a first circulator bank that reproduces said first input sound and changes the reproduced sound into a first input sound array that has a plurality of elements;

a first amplifier that increases or decreases an amplitude of each element of the plurality of elements of said first circulator bank;

a first filter that resonates an frequency component of said each element of the plurality of elements of said first circulator bank after said increasing or decreasing the amplitude by the first amplifier;

a first dynamics processor that regulates an amplitude level or adjusts a dynamic range of said each element of the plurality of elements of said first circulator bank after said resonating the frequency component by the first filter;

a second amplifier that increases or decreases the amplitude of said each element of the plurality of elements of said first circulator bank after said regulating the amplitude level or adjusting the dynamic range by the first dynamics processor;

a third amplifier that scales the amplitude of said each element of the plurality of elements of said first circulator bank after said increasing or decreasing the amplitude by the second amplifier;

a first additive synthesizer that additively synthesizes said each element of the plurality of elements of said first circulator bank after said scaling the amplitudes by the third amplifier; and a fourth amplifier that adjusts a master output level of said first converted sound.

4. A sound regulation method for regulating an environmental sound, the sound regulation method comprising the steps of:

receiving said environmental sound derived from an environment as a first input sound;

converting said first input sound into a first converted sound by applying to said first input sound a first regulated frequency component including a first frequency component that approximates to a first sine-wave oscillator, a first sawtooth-wave oscillator, a first square-wave oscillator or a first triangle-wave oscillator; and a first regulated amplitude;

transmitting said first converted sound as a first output sound to said environment;

receiving a second input sound that is a synthetic sound synthesized from said first output sound and said environmental sound; and converting said second input sound into a second converted sound by applying to said second input sound a second regulated frequency component including a second frequency component that approximates to a second sine-wave oscillator, a second sawtooth-wave oscillator, a second square-wave oscillator or a second triangle-wave oscillator; and a second regulated amplitude.

5. A sound regulation method for regulating an environmental sound, the sound regulation method comprising the steps of:

receiving said environmental sound derived from an environment as a first input sound;

converting said first input sound into a first converted sound that contains a first regulated frequency component including a first frequency component that approximates to a first sine-wave oscillator, a first sawtooth-wave oscillator, a first square-wave oscillator or a first triangle-wave oscillator; or a first regulated amplitude;

transmitting said first converted sound as a first output sound to said environment;

receiving a second input sound that is a synthetic sound synthesized from said first output sound and said environmental sound; and converting said second input sound into a second converted sound that contains a second regulated frequency component including a second frequency component that approximates to a second sine-wave oscillator, a second sawtooth-wave oscillator, a second square-wave oscillator or a second triangle-wave oscillator; or a second regulated amplitude;

wherein said step of converting said first input sound comprises the sub-steps of:

increasing or decreasing an amplitude of said first input sound so as to generate a first scaled amplitude sound;

resonating a first frequency component of the first scaled amplitude sound so as to generate a first resonated sound;

regulating an amplitude level or adjusting a dynamic range of the first resonated sound so as to generate a first regulated sound; and adjusting a master output level from the first regulated sound; and wherein said step of converting said second input sound comprises the sub-steps of:

increasing or decreasing an amplitude of said second input sound so as to generate a second scaled amplitude sound;

resonating a second frequency component of the second scaled amplitude sound so as to generate a second resonated sound;

regulating an amplitude level or adjusting a dynamic range of the second resonated sound so as to generate a second regulated sound; and adjusting a master output level from the second regulated sound.

6. A sound regulation method for regulating an environmental sound, the sound regulation method comprising the steps of:

receiving said environmental sound derived from an environment as a first input sound;

converting said first input sound into a first converted sound that contains a first regulated frequency component including a first frequency component that approximates to a first sine-wave oscillator, a first sawtooth-wave oscillator, a first square-wave oscillator or a first triangle-wave oscillator; or a first regulated amplitude;

transmitting said first converted sound as a first output sound to said environment;

receiving a second input sound that is a synthetic sound synthesized from said first output sound and said environmental sound; and converting said second input sound into a second converted sound that contains a second regulated frequency component including a second frequency component that approximates to a second sine-wave oscillator, a second sawtooth-wave oscillator, a second square-wave oscillator or a second triangle-wave oscillator; or a second regulated amplitude;

wherein said step of converting said first input sound comprises the sub-steps of:

reproducing said first input sound and changing the reproduced sound into a first circulator bank that has a plurality of elements;

increasing or decreasing an amplitude of each element of the plurality of elements of said first circulator bank;

resonating a first frequency component of said each element of the plurality of elements of said first circulator bank;

regulating an amplitude level or adjusting a dynamic range of said each element of the plurality of elements of said first circulator bank;

increasing or decreasing the amplitude of said each element of the plurality of elements of said first circulator bank;

scaling the amplitude of said each element of the plurality of elements of said first circulator bank;

additively synthesizing said each element of the plurality of elements of said first circulator bank; and adjusting a master output level of said first converted sound.

7. A non-transitory computer readable storage medium storing sound regulation program instructions that, when executed by processing circuitry of an apparatus, cause the apparatus to:

receive an environmental sound derived from an environment, through an AD conversion, as a first input sound;

write said first input sound to a memory;

read said first input sound from said memory, and convert said first input sound into a first converted sound by applying to said first input sound a first regulated frequency component including a first frequency component that approximates to a first sine-wave oscillator, a first sawtooth-wave oscillator, a first square-wave oscillator or a first triangle-wave oscillator; and a first regulated amplitude;

write said first converted sound to said memory;

read said first converted sound from said memory, and transmit said first converted sound as a first output sound to said environment through a DA conversion;

receive a second input sound that is a synthetic sound synthesized from said first output sound and said environmental sound; and convert said second input sound into a second converted sound by applying to said second input sound a second regulated frequency component including a second frequency component that approximates to a second sine-wave oscillator, a second sawtooth-wave oscillator, a second square-wave oscillator or a second triangle-wave oscillator; and a second regulated amplitude.

8. A non-transitory computer readable storage medium storing sound regulation program instructions that, when executed by processing circuitry of an apparatus, cause the apparatus to:

receive an environmental sound derived from an environment, through an AD conversion, as a first input sound;

write said first input sound to a memory;

read said first input sound from said memory, and convert said first input sound into a first converted sound that contains a first regulated frequency component including a first frequency component that approximates to a first sine-wave oscillator, a first sawtooth-wave oscillator, a first square-wave oscillator or a first triangle-wave oscillator; or a first regulated amplitude;

write said first converted sound to said memory;

read said first converted sound from said memory, and transmit said first converted sound as a first output sound to said environment through a DA conversion;

receive a second input sound that is a synthetic sound synthesized from said first output sound and said environmental sound; and convert said second input sound into a second converted sound that contains a second regulated frequency component including a second frequency component that approximates to a second sine-wave oscillator, a second sawtooth-wave oscillator, a second square-wave oscillator or a second triangle-wave oscillator; or a second regulated amplitude;

wherein said reading said first input sound from said memory comprises a sub-set of instructions for functioning as:

a first amplifier that, after said first input sound is read from said memory, increases or decreases an amplitude of said first input sound; or said second input sound;

a first filter that resonates a first frequency component of a first sound derived from said first amplifier; or a second frequency component of a second sound derived from said first amplifier;

a first dynamics processor that regulates an amplitude level or adjusts a dynamic range of said first sound derived from said first filter; or said second sound derived from said first filter; and a second amplifier that adjusts a master output level of said first converted sound; or said second converted sound.

9. A non-transitory computer readable storage medium storing sound regulation program instructions that, when executed by processing circuitry of an apparatus, cause the apparatus to:

receive an environmental sound derived from an environment, through an AD conversion, as a first input sound;

write said first input sound to a memory;

read said first input sound from said memory, and convert said first input sound into a first converted sound that contains a first regulated frequency component including a first frequency component that approximates to a first sine-wave oscillator, a first sawtooth-wave oscillator, a first square-wave oscillator or a first triangle-wave oscillator; or a first regulated amplitude;

write said first converted sound to said memory;

read said first converted sound from said memory, and transmit said first converted sound as a first output sound to said environment through a DA conversion;

receive a second input sound that is a synthetic sound synthesized from said first output sound and said environmental sound; and convert said second input sound into a second converted sound that contains a second regulated frequency component including a second frequency component that approximates to a second sine-wave oscillator, a second sawtooth-wave oscillator, a second square-wave oscillator or a second triangle-wave oscillator; or a second regulated amplitude;

wherein said reading said first input sound from said memory comprises a sub-set of instructions for functioning as:

a first circulator bank that, after said first input sound is read from said memory, reproduces said first input sound and changes the reproduced sound into a first input sound array that has a plurality of elements;

a first amplifier that increases or decreases an amplitude of each element of the plurality of elements of said first circulator bank;

a first filter that resonates an frequency component of said each element of the plurality of elements of said first circulator bank after said increasing or decreasing the amplitude by the first amplifier;

a first dynamics processor that regulates an amplitude level or adjusts a dynamic range of said each element of the plurality of elements of said first circulator bank after said resonating the frequency component by the first filter;

a second amplifier that increases or decreases the amplitude of said each element of the plurality of elements of said first circulator bank after said regulating the amplitude level or adjusting the dynamic range by the first dynamics processor;

a third amplifier that scales the amplitude of said each element of the plurality of elements of said first circulator bank after said increasing or decreasing the amplitude by the second amplifier;

a first additive synthesizer that additively synthesizes said each element of the plurality of elements of said first circulator bank after said scaling the amplitude by the third amplifier; and a fourth amplifier that adjusts a master output level of said first converted sound.

* * * * *